US008267721B2

(12) United States Patent
Minich

(10) Patent No.: US 8,267,721 B2
(45) Date of Patent: Sep. 18, 2012

(54) ELECTRICAL CONNECTOR HAVING GROUND PLATES AND GROUND COUPLING BAR

(75) Inventor: Steven E. Minich, York, PA (US)

(73) Assignee: FCI Americas Technology LLC, Carson City, NV (US)

( * ) Notice: Subject to any disclaimer, the term of this patent is extended or adjusted under 35 U.S.C. 154(b) by 21 days.

(21) Appl. No.: 12/908,344

(22) Filed: Oct. 20, 2010

(65) Prior Publication Data

US 2011/0097934 A1 Apr. 28, 2011

Related U.S. Application Data

(60) Provisional application No. 61/255,588, filed on Oct. 28, 2009.

(51) Int. Cl.
*H01R 13/648* (2006.01)

(52) U.S. Cl. ..... 439/607.05; 439/79

(58) Field of Classification Search ..... 439/607.05, 439/607.53, 79, 108, 941
See application file for complete search history.

(56) References Cited

U.S. PATENT DOCUMENTS

| | | | |
|---|---|---|---|
| 2,664,552 | A | 12/1953 | Ericsson et al. |
| 2,849,700 | A | 8/1958 | Perkin |
| 2,858,372 | A | 10/1958 | Kaufman |
| 3,115,379 | A | 12/1963 | McKee |
| 3,286,220 | A | 11/1966 | Marley et al. |
| 3,343,120 | A | 9/1967 | Whiting |
| 3,482,201 | A | 9/1967 | Whiting |
| 3,399,372 | A | 8/1968 | Uberbacher |
| 3,538,486 | A | 11/1970 | Shlesinger, Jr. |
| 3,587,028 | A | 6/1971 | Uberbacher |
| 3,591,834 | A | 7/1971 | Kolias |
| 3,641,475 | A | 2/1972 | Irish et al. |
| 3,663,925 | A | 5/1972 | Proctor |
| 3,669,054 | A | 6/1972 | Desso et al. |
| 3,701,076 | A | 10/1972 | Irish |
| 3,748,633 | A | 7/1973 | Lundergan |
| 3,827,005 | A | 7/1974 | Friend |
| 3,867,008 | A | 2/1975 | Gartland, Jr. |
| 4,030,792 | A | 6/1977 | Fuerst |
| 4,076,362 | A | 2/1978 | Ichimura |
| 4,084,872 | A | 4/1978 | Pritulsky |

(Continued)

FOREIGN PATENT DOCUMENTS

EP 0273683 7/1988

(Continued)

OTHER PUBLICATIONS

International Application No. PCT/US2010/053793: International Search Report dated Apr. 25, 2011, 9 pages.

(Continued)

*Primary Examiner* — Javaid Nasri
(74) *Attorney, Agent, or Firm* — Woodcock Washburn LLP

(57) ABSTRACT

An electrical connector includes a plurality of leadframe assemblies having discrete signal contacts extending through a leadframe housing and defining opposed mating ends and mounting ends. The leadframes lack discrete ground contacts, and instead includes a ground plate having a plurality of mating ends, such that the mating end of at least one signal contact is disposed between a pair of the mating ends of the ground plate. The ground plate further includes a ground coupling bar connected between the pair of mating ends of the ground plate.

20 Claims, 10 Drawing Sheets

U.S. PATENT DOCUMENTS 4,157,612 A 6/1979 Rainal
4,159,861 A 7/1979 Anhalt
4,232,924 A 11/1980 Kline et al.
4,260,212 A 4/1981 Ritchie et al.
4,288,139 A 9/1981 Cobaugh et al.
4,383,724 A 5/1983 Verhoeven
4,402,563 A 9/1983 Sinclair
4,407,552 A 10/1983 Watanabe et al.
4,482,937 A 11/1984 Berg
4,487,464 A 12/1984 Kirschenbaum
4,523,296 A 6/1985 Healy, Jr.
4,560,222 A 12/1985 Dambach
4,571,014 A 2/1986 Robin et al.
4,607,899 A 8/1986 Romine et al.
4,664,456 A 5/1987 Blair et al.
4,664,458 A 5/1987 Worth
4,681,549 A 7/1987 Peterson
4,717,360 A 1/1988 Czaja
4,762,500 A 8/1988 Dola et al.
4,776,803 A 10/1988 Pretchel et al.
4,815,987 A 3/1989 Kawano et al.
4,846,727 A 7/1989 Glover et al.
4,850,887 A 7/1989 Sugawara
4,867,713 A 9/1989 Ozu et al.
4,898,539 A 2/1990 Glover et al.
4,900,271 A 2/1990 Colleran et al.
4,907,990 A 3/1990 Bertho et al.
4,913,664 A 4/1990 Dixon et al.
4,917,616 A 4/1990 Demler, Jr. et al.
4,932,888 A 6/1990 Senor
4,954,093 A 9/1990 Nadin
4,973,271 A 11/1990 Ishizuka et al.
4,975,069 A 12/1990 Fedder et al.
4,997,390 A 3/1991 Scholz et al.
5,004,426 A 4/1991 Barnett
5,046,960 A 9/1991 Fedder
5,055,054 A 10/1991 Doutrich
5,065,282 A 11/1991 Polonio
5,066,236 A 11/1991 Broeksteeg
5,077,893 A 1/1992 Mosquera et al.
5,094,623 A 3/1992 Scharf et al.
5,098,311 A 3/1992 Roath et al.
5,104,341 A 4/1992 Gilissen et al.
5,127,839 A 7/1992 Korsunsky et al.
5,141,455 A 8/1992 Ponn
5,161,987 A 11/1992 Sinisi
5,163,337 A 11/1992 Herron et al.
5,163,849 A 11/1992 Fogg et al.
5,167,528 A 12/1992 Nishiyama et al.
5,169,337 A 12/1992 Ortega et al.
5,174,770 A 12/1992 Sasaki et al.
5,181,855 A 1/1993 Mosquera et al.
5,186,647 A * 2/1993 Denkmann et al. ..... 439/395
5,197,893 A 3/1993 Morlion et al.
5,228,864 A 7/1993 Fusselman et al.
5,238,414 A 8/1993 Yaegashi et al.
5,254,012 A 10/1993 Wang
5,257,941 A 11/1993 Lwee et al.
5,274,918 A 1/1994 Reed
5,277,624 A 1/1994 Champion et al.
5,286,212 A 2/1994 Broeksteeg
5,288,949 A 2/1994 Crafts
5,302,135 A 4/1994 Lee
5,330,371 A 7/1994 Andrews
5,342,211 A 8/1994 Broeksteeg
5,356,300 A 10/1994 Costello et al.
5,356,301 A 10/1994 Champion et al.
5,357,050 A 10/1994 Baran et al.
5,382,168 A 1/1995 Azuma et al.
5,387,111 A 2/1995 DeSantis et al.
5,395,250 A 3/1995 Englert, Jr. et al.
5,399,104 A 3/1995 Middlehurst et al.
5,413,491 A 5/1995 Noschese
5,429,520 A 7/1995 Morlion et al.
5,431,578 A 7/1995 Wayne
5,475,922 A 12/1995 Tamura et al.
5,518,422 A 5/1996 Zell et al.
5,522,727 A 6/1996 Saito et al.
5,522,738 A 6/1996 Lace
5,558,542 A 9/1996 O'Sullivan et al.
5,564,949 A 10/1996 Wellinsky
5,575,688 A 11/1996 Crane, Jr.
5,586,908 A 12/1996 Lorrain
5,586,912 A 12/1996 Eslampour et al.
5,586,914 A 12/1996 Foster, Jr. et al.
5,590,463 A 1/1997 Feldman et al.
5,609,502 A 3/1997 Thumma
5,620,340 A 4/1997 Andrews
5,626,492 A 5/1997 Onizuka et al.
5,634,821 A 6/1997 Crane, Jr.
5,637,019 A 6/1997 Crane, Jr. et al.
5,664,968 A 9/1997 Mickievicz
5,668,408 A 9/1997 Nicholson
5,672,064 A 9/1997 Provencher et al.
5,697,799 A 12/1997 Consoli et al.
5,713,746 A 2/1998 Olson et al.
5,713,767 A 2/1998 Hanson et al.
5,730,609 A 3/1998 Harwath
5,741,144 A 4/1998 Elco et al.
5,741,161 A 4/1998 Cahaly et al.
5,766,023 A 6/1998 Noschese et al.
5,775,947 A 7/1998 Suzuki et al.
5,782,656 A 7/1998 Zell et al.
5,795,191 A 8/1998 Preputnick et al.
5,803,768 A 9/1998 Zell et al.
5,817,973 A 10/1998 Elco
5,820,392 A 10/1998 Lin et al.
5,833,475 A 11/1998 Mitra
5,853,797 A 12/1998 Fuchs et al.
5,860,816 A 1/1999 Provencher et al.
5,871,362 A 2/1999 Campbell et al.
5,876,222 A 3/1999 Gardner et al.
5,882,227 A 3/1999 Neidich
5,887,158 A 3/1999 Sample et al.
5,892,791 A 4/1999 Moon
5,893,761 A 4/1999 Longueville
5,902,136 A 5/1999 Lemke et al.
5,904,581 A 5/1999 Pope et al.
5,908,333 A 6/1999 Perino et al.
5,921,810 A 7/1999 Murakoshi
5,938,479 A 8/1999 Paulson et al.
5,961,355 A 10/1999 Morlion et al.
5,967,844 A 10/1999 Doutrich et al.
5,971,817 A 10/1999 Longueville
5,980,321 A 11/1999 Cohen et al.
5,984,690 A 11/1999 Riechelmann et al.
5,992,953 A 11/1999 Rabinovitz
5,993,259 A 11/1999 Stokoe et al.
6,007,376 A 12/1999 Shimizu
6,022,227 A 2/2000 Huang
6,027,345 A 2/2000 McHugh et al.
6,042,427 A 3/2000 Adriaenssens et al.
6,050,862 A 4/2000 Ishii
6,068,520 A 5/2000 Winings et al.
6,086,386 A 7/2000 Fjelstad et al.
6,116,926 A 9/2000 Ortega et al.
6,116,965 A 9/2000 Arnett et al.
6,123,554 A 9/2000 Ortega et al.
6,125,535 A 10/2000 Chiou et al.
6,129,592 A 10/2000 Mickievicz et al.
6,132,255 A 10/2000 Verhoeven
6,139,336 A 10/2000 Olson
6,146,157 A 11/2000 Lenoir et al.
6,146,203 A 11/2000 Elco et al.
6,152,747 A 11/2000 McNamara
6,154,742 A 11/2000 Herriot
6,168,469 B1 1/2001 Lu
6,171,115 B1 1/2001 Mickievicz et al.
6,171,149 B1 1/2001 Van Zanten
6,179,663 B1 1/2001 Bradley et al.
6,190,213 B1 2/2001 Reichart et al.
6,210,227 B1 4/2001 Yamasaki et al.
6,212,755 B1 4/2001 Shimada et al.
6,219,913 B1 4/2001 Uchiyama
6,220,896 B1 4/2001 Bertoncini et al.
6,224,432 B1 5/2001 Billman
6,227,882 B1 5/2001 Ortega et al.

6,241,535 B1 6/2001 Lemke et al.
6,267,604 B1 7/2001 Mickievicz et al.
6,269,539 B1 8/2001 Takahashi et al.
6,273,759 B1 8/2001 Perino et al.
6,280,209 B1 8/2001 Bassler et al.
6,280,809 B1 8/2001 Wang et al.
6,293,827 B1 9/2001 Stokoe
6,299,483 B1 10/2001 Cohen et al.
6,299,484 B2 10/2001 Van Woensel
6,302,711 B1 10/2001 Ito
6,319,075 B1 11/2001 Clark et al.
6,322,379 B1 11/2001 Ortega et al.
6,322,393 B1 11/2001 Doutrich et al.
6,328,602 B1 12/2001 Yamasaki et al.
6,338,635 B1 1/2002 Lee
6,343,955 B2 2/2002 Billman et al.
6,347,952 B1 2/2002 Hasegawa et al.
6,347,962 B1 2/2002 Kline
6,350,134 B1 2/2002 Fogg et al.
6,354,877 B1 3/2002 Shuey et al.
6,358,061 B1 3/2002 Regnier
6,361,366 B1 3/2002 Shuey et al.
6,363,607 B1 4/2002 Chen et al.
6,364,710 B1 4/2002 Billman et al.
6,371,773 B1 4/2002 Crofoot et al.
6,375,474 B1 4/2002 Harper, Jr. et al.
6,375,478 B1 4/2002 Kikuchi
6,379,188 B1 4/2002 Cohen et al.
6,386,914 B1 5/2002 Collins et al.
6,390,826 B1 5/2002 Affolter et al.
6,409,543 B1 6/2002 Astbury, Jr. et al.
6,414,248 B1 7/2002 Sundstrom
6,420,778 B1 7/2002 Sinyansky
6,431,914 B1 8/2002 Billman
6,435,914 B1 8/2002 Billman
6,457,983 B1 10/2002 Bassler et al.
6,461,202 B2 10/2002 Kline
6,464,529 B1 10/2002 Jensen et al.
6,471,548 B2 10/2002 Bertoncini et al.
6,482,038 B2 11/2002 Olson
6,485,330 B1 11/2002 Doutrich
6,494,734 B1 12/2002 Shuey
6,503,103 B1 1/2003 Cohen et al.
6,506,076 B2 1/2003 Cohen et al.
6,506,081 B2 1/2003 Blanchfield et al.
6,520,803 B1 2/2003 Dunn
6,526,519 B1 2/2003 Cuthbert
6,527,587 B1 3/2003 Ortega et al.
6,528,737 B1 3/2003 Kwong et al.
6,530,134 B1 3/2003 Laphan et al.
6,537,086 B1 3/2003 Mac Mullin
6,537,087 B2 3/2003 McNamara et al.
6,537,111 B2 3/2003 Brammer et al.
6,540,522 B2 4/2003 Sipe
6,540,558 B1 4/2003 Paagman
6,540,559 B1 4/2003 Kemmick et al.
6,547,066 B2 4/2003 Koch
6,551,140 B2 4/2003 Billman et al.
6,554,640 B1 4/2003 Koike et al.
6,554,647 B1 4/2003 Cohen et al.
6,561,849 B2 5/2003 Naito et al.
6,565,387 B2 5/2003 Cohen
6,565,388 B1 5/2003 Van Woensel et al.
6,572,409 B2 6/2003 Nitta et al.
6,572,410 B1 6/2003 Volstorf et al.
6,589,071 B1 7/2003 Lias et al.
6,592,381 B2 7/2003 Cohen et al.
6,602,095 B2 8/2003 Astbury, Jr. et al.
6,607,402 B2 8/2003 Cohen et al.
6,609,933 B2 8/2003 Yamasaki
6,633,490 B2 10/2003 Centola et al.
6,641,411 B1 11/2003 Stoddard et al.
6,641,825 B2 11/2003 Scholz et al.
6,648,657 B1 11/2003 Korsunsky et al.
6,652,318 B1 11/2003 Winings et al.
6,655,966 B2 12/2003 Rothermel et al.
6,659,808 B2 12/2003 Billman et al.
6,672,886 B2 1/2004 Billman
6,672,907 B2 1/2004 Azuma
6,692,272 B2 2/2004 Lemke et al.
6,695,627 B2 2/2004 Ortega et al.
6,712,646 B2 3/2004 Shindo
6,717,825 B2 4/2004 Volstorf
6,736,664 B2 5/2004 Ueda et al.
6,743,057 B2 6/2004 Davis et al.
6,746,278 B2 6/2004 Nelson et al.
6,749,439 B1 6/2004 Potter et al.
6,749,468 B2 6/2004 Avery
6,762,067 B1 7/2004 Quinones et al.
6,764,341 B2 7/2004 Lappoehn
6,776,649 B2 8/2004 Pape et al.
6,786,771 B2 9/2004 Gailus
6,797,215 B2 9/2004 Bonk et al.
6,805,278 B1 10/2004 Olson et al.
6,808,399 B2 10/2004 Rothermel et al.
6,808,420 B2 10/2004 Whiteman, Jr. et al.
6,814,590 B2 * 11/2004 Minich et al. ..... 439/79
6,824,391 B2 11/2004 Mickievicz et al.
6,835,072 B2 12/2004 Simons et al.
6,843,679 B2 1/2005 Kuo et al.
6,843,686 B2 1/2005 Ohnishi et al.
6,848,944 B2 2/2005 Evans
6,851,974 B2 2/2005 Doutrich
6,851,980 B2 2/2005 Nelson et al.
6,852,567 B1 2/2005 Lee et al.
6,863,543 B2 3/2005 Lang et al.
6,869,292 B2 3/2005 Johnescu et al.
6,872,085 B1 3/2005 Cohen et al.
6,884,117 B2 4/2005 Korsunsky et al.
6,890,214 B2 5/2005 Brown et al.
6,893,300 B2 5/2005 Zhou et al.
6,893,686 B2 5/2005 Egan
6,899,566 B2 5/2005 Kline et al.
6,902,411 B2 6/2005 Kubo
6,913,490 B2 7/2005 Whiteman, Jr. et al.
6,918,776 B2 7/2005 Spink, Jr.
6,918,789 B2 7/2005 Lang et al.
6,932,649 B1 8/2005 Rothermel et al.
6,939,173 B1 9/2005 Elco et al.
6,945,796 B2 9/2005 Bassler et al.
6,951,466 B2 10/2005 Sandoval et al.
6,953,351 B2 10/2005 Fromm et al.
6,960,103 B2 11/2005 Tokunaga
6,969,280 B2 11/2005 Chien et al.
6,976,886 B2 12/2005 Winings et al.
6,979,215 B2 12/2005 Avery et al.
6,981,883 B2 1/2006 Raistrick et al.
6,988,902 B2 1/2006 Winings et al.
6,994,569 B2 2/2006 Minich et al.
7,001,188 B2 2/2006 Kobayashi
7,021,975 B2 4/2006 Lappöhn
7,040,901 B2 5/2006 Benham et al.
7,044,794 B2 5/2006 Consoli et al.
7,074,086 B2 7/2006 Cohen et al.
7,090,501 B1 8/2006 Scherer et al.
7,094,102 B2 8/2006 Cohen et al.
7,097,506 B2 8/2006 Nakada
7,101,191 B2 9/2006 Benham et al.
7,108,556 B2 9/2006 Cohen et al.
7,114,964 B2 10/2006 Winings et al.
7,118,391 B2 10/2006 Minich et al.
7,131,870 B2 11/2006 Whiteman, Jr. et al.
7,137,832 B2 11/2006 Mongold et al.
7,139,176 B2 11/2006 Taniguchi et al.
7,153,162 B2 12/2006 Mizumura et al.
7,172,461 B2 2/2007 Davis et al.
7,175,446 B2 2/2007 Bright et al.
7,179,108 B2 2/2007 Goodman et al.
7,186,123 B2 3/2007 Lemke et al.
7,207,807 B2 4/2007 Fogg
7,207,836 B2 4/2007 Tsai
7,239,526 B1 7/2007 Bibee
7,241,168 B2 7/2007 Sakurai et al.
7,247,050 B1 7/2007 Minich et al.
7,270,574 B1 9/2007 Ngo
7,278,856 B2 10/2007 Minich
7,281,950 B2 10/2007 Belopolsky
7,285,018 B2 10/2007 Kenny et al.

| | | | |
|---|---|---|---|
| 7,292,055 | B2 | 11/2007 | Egitto et al. |
| 7,310,875 | B2 | 12/2007 | Evans |
| 7,322,855 | B2 | 1/2008 | Mongold et al. |
| 7,331,802 | B2 | 2/2008 | Rothermel et al. |
| 7,331,830 | B2 | 2/2008 | Minich |
| 7,396,259 | B2 | 7/2008 | Marshall |
| 7,407,387 | B2 | 8/2008 | Johnescu et al. |
| 7,429,176 | B2 | 9/2008 | Johnescu et al. |
| 7,431,616 | B2 | 10/2008 | Minich |
| 7,462,924 | B2 | 12/2008 | Shuey |
| 7,497,735 | B2 | 3/2009 | Belopolsky |
| 7,497,736 | B2 | 3/2009 | Minich et al. |
| 7,500,871 | B2 | 3/2009 | Minich et al. |
| 7,524,209 | B2 | 4/2009 | Hull et al. |
| 7,534,142 | B2 | 5/2009 | Avery et al. |
| 7,553,182 | B2 | 6/2009 | Buck et al. |
| 7,621,781 | B2 | 11/2009 | Rothermel et al. |
| 7,651,337 | B2 | 1/2010 | McNamara |
| 7,762,843 | B2 | 7/2010 | Minich et al. |
| 7,811,100 | B2 | 10/2010 | Stoner |
| 8,137,119 | B2 | 3/2012 | Stoner |
| 2001/0012729 | A1 | 8/2001 | Van Woensel |
| 2001/0046810 | A1 | 11/2001 | Cohen et al. |
| 2002/0039857 | A1 | 4/2002 | Naito et al. |
| 2002/0084105 | A1 | 7/2002 | Geng et al. |
| 2002/0098727 | A1 | 7/2002 | McNamara et al. |
| 2002/0106930 | A1 | 8/2002 | Pape et al. |
| 2002/0111068 | A1 | 8/2002 | Cohen et al. |
| 2002/0115318 | A1 | 8/2002 | Apicelli |
| 2002/0127903 | A1 | 9/2002 | Billman et al. |
| 2003/0116857 | A1 | 6/2003 | Taniguchi et al. |
| 2003/0143894 | A1 | 7/2003 | Kline et al. |
| 2003/0171010 | A1 | 9/2003 | Winings et al. |
| 2003/0203665 | A1 | 10/2003 | Ohnishi et al. |
| 2003/0220021 | A1 | 11/2003 | Whiteman et al. |
| 2004/0157477 | A1 | 8/2004 | Johnson et al. |
| 2004/0224559 | A1 | 11/2004 | Nelson et al. |
| 2004/0235321 | A1 | 11/2004 | Mizumura et al. |
| 2005/0009402 | A1 | 1/2005 | Chien et al. |
| 2005/0032401 | A1 | 2/2005 | Kpbayashi |
| 2005/0048838 | A1 | 3/2005 | Korsunsky et al. |
| 2005/0079763 | A1 | 4/2005 | Lemke et al. |
| 2005/0101188 | A1 | 5/2005 | Benham et al. |
| 2005/0118869 | A1 | 6/2005 | Evans |
| 2005/0148239 | A1 | 7/2005 | Hull et al. |
| 2005/0164555 | A1 | 7/2005 | Winings et al. |
| 2005/0170700 | A1 | 8/2005 | Shuey et al. |
| 2005/0196987 | A1 | 9/2005 | Shuey et al. |
| 2005/0202722 | A1 | 9/2005 | Regnier et al. |
| 2005/0215121 | A1 | 9/2005 | Tokunaga |
| 2005/0227552 | A1 | 10/2005 | Yamashita et al. |
| 2005/0277315 | A1 | 12/2005 | Mongold et al. |
| 2005/0287869 | A1 | 12/2005 | Kenny et al. |
| 2006/0014433 | A1 | 1/2006 | Consoli et al. |
| 2006/0024983 | A1 | 2/2006 | Cohen et al. |
| 2006/0024984 | A1 | 2/2006 | Winings et al. |
| 2006/0046526 | A1 | 3/2006 | Minich |
| 2006/0051987 | A1 | 3/2006 | Goodman et al. |
| 2006/0068610 | A1 | 3/2006 | Belopolsky |
| 2006/0068641 | A1 | 3/2006 | Hull et al. |
| 2006/0073709 | A1 | 4/2006 | Reid |
| 2006/0116857 | A1 | 6/2006 | Sevic et al. |
| 2006/0121749 | A1 | 6/2006 | Fogg |
| 2006/0192274 | A1 | 8/2006 | Lee et al. |
| 2006/0216969 | A1 | 9/2006 | Bright et al. |
| 2006/0228912 | A1 | 10/2006 | Morlion et al. |
| 2006/0232301 | A1 | 10/2006 | Morlion et al. |
| 2007/0004287 | A1 | 1/2007 | Marshall |
| 2007/0054554 | A1 | 3/2007 | Do et al. |
| 2007/0099455 | A1 | 5/2007 | Rothermel et al. |
| 2007/0205774 | A1 | 9/2007 | Minich |
| 2007/0207641 | A1 | 9/2007 | Minich |
| 2008/0045079 | A1 | 2/2008 | Minich et al. |
| 2008/0096424 | A1 | 4/2008 | Bixler et al. |
| 2008/0176453 | A1 | 7/2008 | Minich et al. |
| 2008/0233806 | A1 | 9/2008 | Rothermel et al. |
| 2009/0011641 | A1 | 1/2009 | Cohen et al. |
| 2009/0017652 | A1 | 1/2009 | Stoner |
| 2009/0017682 | A1 | 1/2009 | Amleshi et al. |
| 2009/0221165 | A1 | 9/2009 | Buck et al. |
| 2009/0303689 | A1 | 12/2009 | Chang |
| 2010/0240233 | A1 | 9/2010 | Johnescu et al. |

FOREIGN PATENT DOCUMENTS

| | | |
|---|---|---|
| EP | 0554821 | 8/1993 |
| EP | 0635910 | 1/1995 |
| EP | 0932226 | 7/1998 |
| EP | 0891016 | 10/2002 |
| EP | 1148587 | 4/2005 |
| EP | 1635429 | 3/2006 |
| EP | 1933422 | 6/2008 |
| JP | 02-284372 | 11/1990 |
| JP | 03-266383 | 11/1991 |
| JP | 06-236788 | 8/1994 |
| JP | 07-114958 | 5/1995 |
| JP | 11-185886 | 7/1999 |
| JP | 2000-003743 | 1/2000 |
| JP | 2000-003744 | 1/2000 |
| JP | 2000-003745 | 1/2000 |
| JP | 2000-003746 | 1/2000 |
| JP | 2004-103527 | 4/2004 |
| WO | WO 90/16093 | 12/1990 |
| WO | WO 01/29931 | 4/2001 |
| WO | WO 01/39332 | 5/2001 |
| WO | WO 02/01882 | 12/2002 |
| WO | WO 2006/031296 | 3/2006 |
| WO | WO 2006/105535 | 10/2006 |
| WO | WO 2008/082548 | 7/2008 |

OTHER PUBLICATIONS

U.S. Appl. No. 10/779,172, filed Feb. 11, 2004, Johnescu.

U.S. Appl. No. 10/940,329, filed Sep. 14, 2004, Johnescu.

U.S. Appl. No. 12/833,322, filed Jul. 9, 2010, Stoner.

"4.0 UHD Connector: Differential Signal Crosstalk, Reflections" 1998, 2 pages.

"B.? Bandwidth and Rise Time Budgets" Module 1-8. Fiber Optic Telecommunications (E-XVI-2a), http://cord.org/step_online/st1-8/st18exvi2a.htm, access date Feb. 27, 2006, 3 pages.

AMP "AMP Z-Pack 2mm HM Interconnection System" 1992© and 1994© AMP Incorporated, 6 pages.

AMP "Z-Pack 2mm HM Connector, 2mm Centerline, Eight-Row, Right-Angle Applications" Electrical Performance Report, Sep. 1998, 59 pages.

AMP, "High Speed Backplance Connectors", Tyco Electronics, www.tycoelectronics.com, Apr. 2005, 21 pages.

Amphenol TCS (ATCS), "HDM® HDM Plus® Connectors", http://www.teradyne.com/prods/tcs/products/connectors/backplane/xcede/index.html, access date Jun. 19, 2008, 5 pages.

Amphenol TCS (ATCS), "VHDM L-Series Connector", http://www.teradyne.com/prods/tcs/products/connectors/backplane/vhdm_1-series/index.html, access date Jan. 31, 2006, 4 pages.

Amphenol TCS (ATCS), "XCede® Connector", http://www.amphenol-tcs.com/products/connectors/backplane/xcede/index.html, access date Jun. 19, 2008, 5 pages.

Amphenol TCS, "HDM® Stacker Signal Integrity", http://www.teradyne.com/prods/tcs/prducts/connectors/mezzanine/hdm_stacker/signintegrity.html., access date Feb. 2, 2006, 3 pages.

Amphenol TCS, "Ventura® High Performance, Highest Density Available", http://www.amphenol-tcs.com/products/connectors/backplane/ventura/index.html, access.date Jun. 19, 2008, 2 pages.

Amphenol TCS, "VHDM® Connector", http://www.teradyne.com/prods/tcs/products/connectors/backplane/vhdmn/index.html, access date Feb. 8, 2006, 2 pages.

Amphenol TSC, "Backplane Connectors" http://www.amphenol-tcs.com/products/connectors/backplane/index.html, access dated Jun. 19, 2008, 3 pages.

Amphenol, "TB-2127 VENTURA™ Application Design Guide", Revision, "General Release", Aug. 25, 2005, Amphenol Corporation ©2006, 1-13.

DesignCon, "Interconnect Design Optimization and Characterization for Advanced High Speed Backplane Channel Links", 2009, 38 pages.

FcCIDrawing, "Framatome Connectors" Specification, May 10, 1999, 1 page.
FCI Framatome Group, "Metral@ 2mm High-Speed Connectors, 1000, 2000, 3000 Series", Electrical Performance Data for Differential Applications, 2 pages.
FCI, "Airmax Vs Connector System Honored at DesignCon", Heilind Electrnoics, Inc., 02005, accessed date Feb. 8, 2006, http://www.heilind.com/products/fci/airmax-vs-design.asp., 1 page.
FCI, "Airmax VS®, High Speed Connector System" Communications, Data, Consumer Division, 16 pages.
FCI, "Communications, Data, Consumer Division: Mezzanine High-Speed High-Density Connectors GIG-Array® and Meg-Array®", Electrical Performance Data, 10 pages.
FCI, "GIG-ARRAY ® High Speed Mezzanine Connectors 15-40 mm Board to Board", Jun. 5, 2006, 24 pages.
FCI, "Gig-Array° Connector System", Board to Board Connectors, 4 pages.
FCI, Drawing "Millipacs 5+2R STR HDR Connector Type A" Specification, Dec. 14, 2004, 1 page.
Fusi et al., "Differential Signal Transmission through Backplanes and Connectors", Electronic Packaging and Production, Mar. 1996, 27-31.
Goel et al., "AMP Z-Pack Interconnect System", AMP Incorporated, ©1990, 9 pages.
Honda Connectors, "Honda High-Speed Backplane Connector NSP Series", Honda Tsuschin Kogyo Co., Ltd. Development Engineering Division, Tokyo Japan, Feb. 7, 2003, 27 pages.
Hult, B., "FCI's Problem Solving Approach Changes Market, The FCI Electronics AirMax VS®", ConnectorSupplier.com, http://www.connectorsupplier.com/tech_updates_FCIAirmax_archive.htm, access date Feb. 7, 2006, 4 pages.
International Patent Application No. PCT/US2009/035388, International Search Report dated Oct. 12, 2009, 3 pages.
International Patent Application No. PCT/US2010/059639: International Search Report dated Aug. 26, 2011, 3 pages.
Lucent Technologies, "Lucent Technologies' Bell Labs and FCI Demonstrate 25gb/S Data Transmission over Electrical Backplane Connectors", http://www.lucent.com/press/0205/050201bia.html, Feb. 1, 2005, accessed date, Feb. 23, 2006, 4 pages.
Metral™, "PCB-Mounted Receptacle Assemblies, 2.00 mm(0.079in) Centerlines, Right-Angle Solder-to-Board Signal Receptacle", Metral™, Berg Electronics, Oct. 6-Oct.-7 (2 pages).
Metral™, "Speed & Density Extensions", FCI, Jun. 3, 1999, 1-25.
Molex Incorporated Drawings, 1.0 HDMI Right Angle Header Assembly (19 PIN) Lead Free, Jul. 20, 2004, 7 pages.
Molex, "Features and Specifications: Impact Backplane Connector System", www.molex.com/link/Impact.html, May 2008, 5 pages.
Molex, "GbXI-Trac ™ Backplane Connector System", www.molex.com/cgi-bin/bv/molex/jsp/family/intro.jsp?BV_SessionID=@@@@102.html, access date Jun. 19, 2008, 3 pages.
Molex, "HDM* Separable Interface Detail", Molex®, 3 pages.
Molex, "High Definition Multimedia Interface (HDMI)", www.molex.com/cgi-bin/bv/molex/jsp/family/intro.jsp?BV_SessionID=@@@@118.html, access date Jun. 19, 2008, 2 pages.
Molex, "Overview: Backplane Products", Backplane Products Overview Page, http://www.molex.com/cgi-bin/bv/molex/super_family/jsp?BV_SessionID=@, ©2005-2006 Molex, accessed date Feb. 8, 2006, 4 pages.
Molex, "Overview: Backplane Products", Backplane Products, http://www.molex.com/cgi-bin.bv/molex/super_/super_family.jsp?BV_SessionID=@, date Jun. 19, 2008, 3 pages.
Nadolny, J. et al., "Optimizing Connector Selection for Gigabit Signal Speeds", ECN™, Sep. 1, 2000, http://www.ecnmag.com/optimizing-connector-selection.aspx, 2 pages.
NSP, "Honda the World Famous Connectors", http://www.honda-connectors.co.jp, 6 pages (English Translation Attached).
Samtec, "High Speed Characterization Report, SEAM-30-02.0-S-10-2 Mates with SEAF-30-05.0-S-10-2, Open Pin Field Array, 1.27 mm×1.27mm Pitch 7mm Stack Height", ©2005, www.samtec.com, 55 pages.
Samtec, Extended Life Product, "Open Pin Field Array Seaf Series", www.samtec.com, 1 page.
Teradyne Connection Systems, Inc., "Daughtercard Connector Assembly" Customer Use Drawing No. C-163-5101-500, Rev. 04, 1 page.
Teradyne, "VHDM High-Speed Differential (VHDM HSD)", http://www.teradyne.com/prods/bps/vhdm/hsd.html, access date Jan. 24, 2000, 6 pages.
Teradyne, Inc., "HDM/HDM *plus*, 2mm Backplane Interconnection System", Teradyne Connection Systems, ©1993, 22 pages.
Teradyne, V"HDM Daughterboard Connectors Feature press-fit Terminations and a Non-Stubbing Seperable Interface", ©Teradyne, Inc. Connections Systems Division, Oct. 8, 1997, 46 pages.
Tyco Electronics , "AMP Z-Pack HM-ZD Performance at Gigabit Speeds", Circuits & Design Electrical Analysis Report, May 4, 2001, 32 pages.
Tyco Electronics Engineering Drawing, Impact, "3 Pair 10 col. Signal Module", Mar. 25, 2008, 1 page.
Tyco Electronics Engineering Drawing, Impact, "3 Pair Header Unguided Open Assembly", Apr. 11, 2008, 1 page.
Tyco Electronics, "Champ Z-Dok Connector System", Catalog # 1309281, Issued Jan. 2002, 3 pages.
Tyco Electronics, "High Speed Backplane Interconnect Solutions", Jul. 2007, 6 pages.
Tyco Electronics, "Impact™ Connector Offered by Tyco Electronics, High Speed Backplane Connector System", Apr. 15, 2008, 12 pages.
Tyco Electronics, "Overview for High Density Backplane Connector (Z-Pack TinMan)", ©2008, 1 page.
Tyco Electronics, "Overview for High Density Backplane Connectors (Impact™) Offered by Tyco Electronics", www.tycoelectronics.com/catalog/minf/en/576?MRID=46636&Bml=10576,1756.html, ©2008, 2 pages.
Tyco Electronics, "Two-Piece, High-Speed Connectors", www.tycoelectronics.com/catalog/menu/en/17654?BML=10576,17560,17536,17759, ©2008, 3 pages.
Tyco Electronics, "Z-Dok+ Connector", Tyco Electronics, May 23, 2003, http://2dok.tyco.electronics.com, 16 pages.
Tyco Electronics, "Z-Pack Slim UHD", http://www.zpackuhd.com, ©2007, 8 pages.
Tyco Electronics, "Z-Pack TinMan Product Portfolio Expanded to Include 6-Pair Module", Jun. 17, 2008, 1 page.
Tyco Electronics/AMP, "Z-Dok* and Z-Dok+ Connectors", Application Specification # 114-13068, Aug. 30, 2005, Revision A, 16 pages.
U.S. Appl. No. 12/833,322: Non-Final Office Action, dated Feb. 18, 2011, 11 pages.
U.S. Appl. No. 12/833,322, Response to Final Rejection dated Jul. 25, 2011, dated Oct. 25, 2011, 7 pages.
U.S. Appl. No. 12/833,322: Final Rejection dated Jul. 25, 2011, 25 pages.
U.S. Appl. No. 12/833,322: Response to Office Action dated Feb. 18, 2011, dated May 18, 2011, 11 pages.

* cited by examiner

ELECTRICAL CONNECTOR HAVING GROUND PLATES AND GROUND COUPLING BAR

CROSS-REFERENCE TO RELATED APPLICATIONS

This application claims priority to U.S. Provisional Patent Application Ser. No. 61/255,588, filed Oct. 28, 2009, the disclosure of which is hereby incorporated by reference as if set forth in its entirety herein.

BACKGROUND

Electrical connectors provide signal connections between electronic devices using signal contacts. Often, the signal contacts are so closely spaced that undesirable interference, or "cross talk," occurs between adjacent signal contacts. Cross talk occurs when a signal in one signal contact induces electrical interference in an adjacent signal contact due to interfering electrical fields, thereby compromising signal integrity. Cross talk may also occur between differential signal pairs. Cross talk increases with reduced distance between the interfering signal contacts. Cross talk may be reduced by separating adjacent signal contacts or adjacent differential signal pairs with ground contacts.

With electronic device miniaturization and high speed signal transmission, high signal integrity electronic communications and the reduction of cross talk become a significant factor in connector design. It is desired to provide an improved connector reducing the problematic occurrence of cross talk, especially for high speed connectors.

SUMMARY

One aspect of the present disclosure is related to a shorter electrical ground path at a mating end of the connector. In accordance with one embodiment, an electrical connector includes a housing and a plurality of electrical signal contacts carried by the housing. The electrical signal contacts each define mating ends and opposed respective mounting ends. The electrical connector further includes a ground plate having a body and at least a first mating end and a second mating end that each extend out from the body at a location such that the mating end of at least one of the plurality of electrical signal contacts is disposed between the first and second mating ends of the ground plate. The ground plate further includes a ground coupling beam connected between the first and second mating ends of the ground plate and isolated from the mating end of the at least one of the plurality of electrical signal contacts.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the present disclosure, reference to the drawings is made. The scope of the disclosure is not limited, however, to the specific instrumentalities disclosed in the drawings. In the drawings.

DETAILED DESCRIPTION

Figure 1:
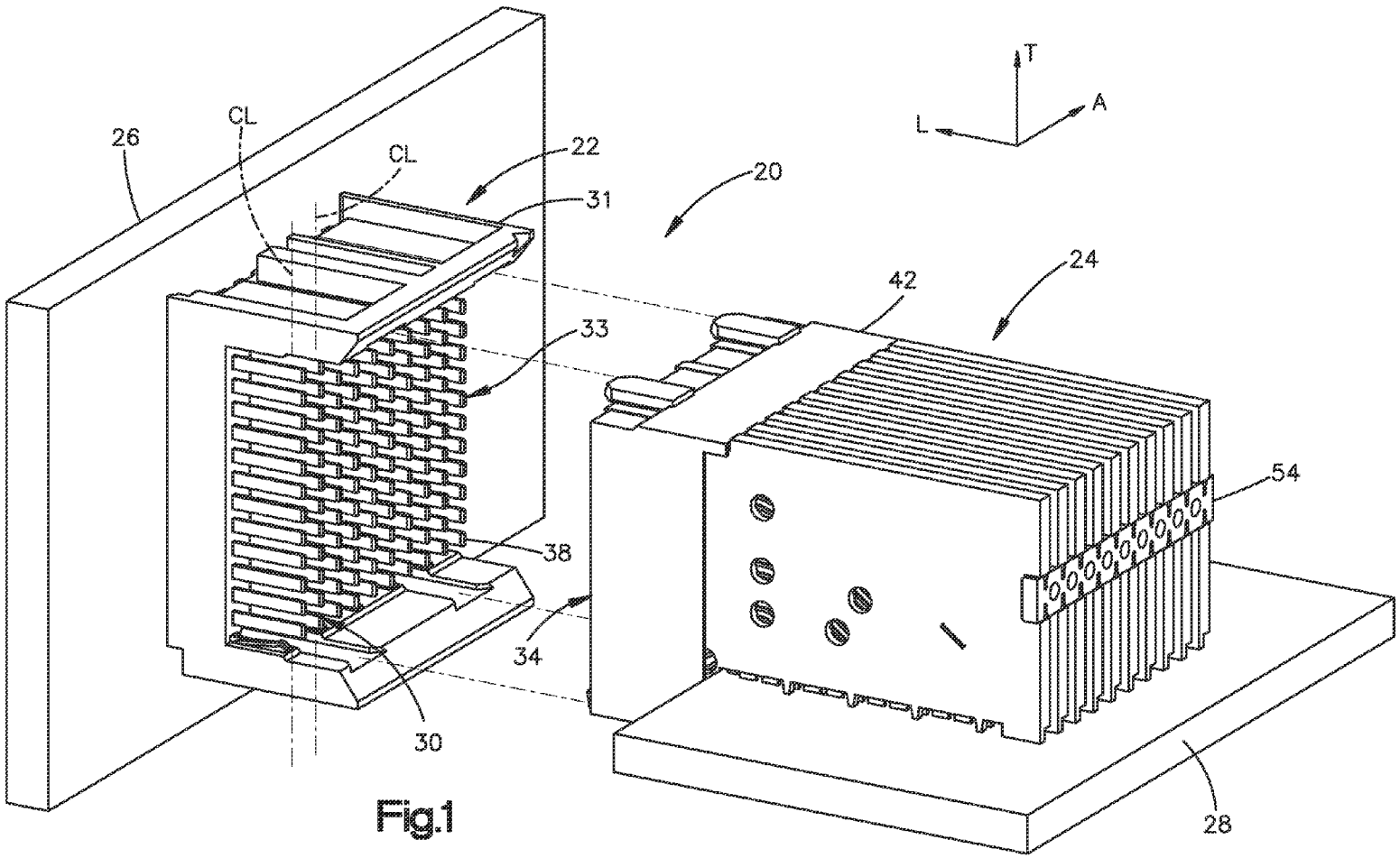
FIG. 1 is a perspective view of an electrical connector assembly including a vertical header connector and a right-angle receptacle connector mounted onto respective substrates, and configured to be mated with each other.
Figure 2A:
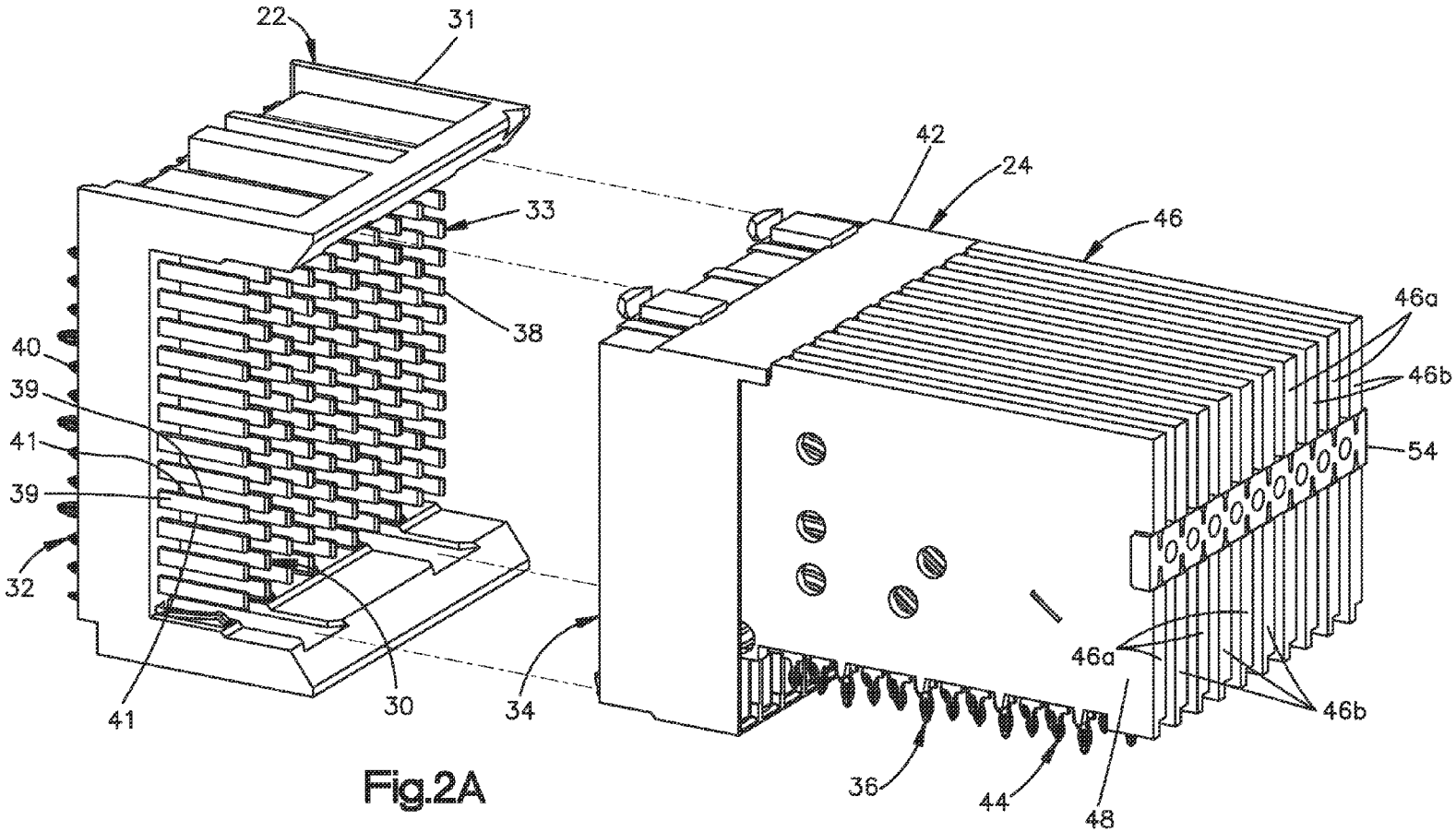
FIG. 2A is a perspective view of the electrical connector assembly similar to FIG. 1, but without the substrates.
Figure 2B:
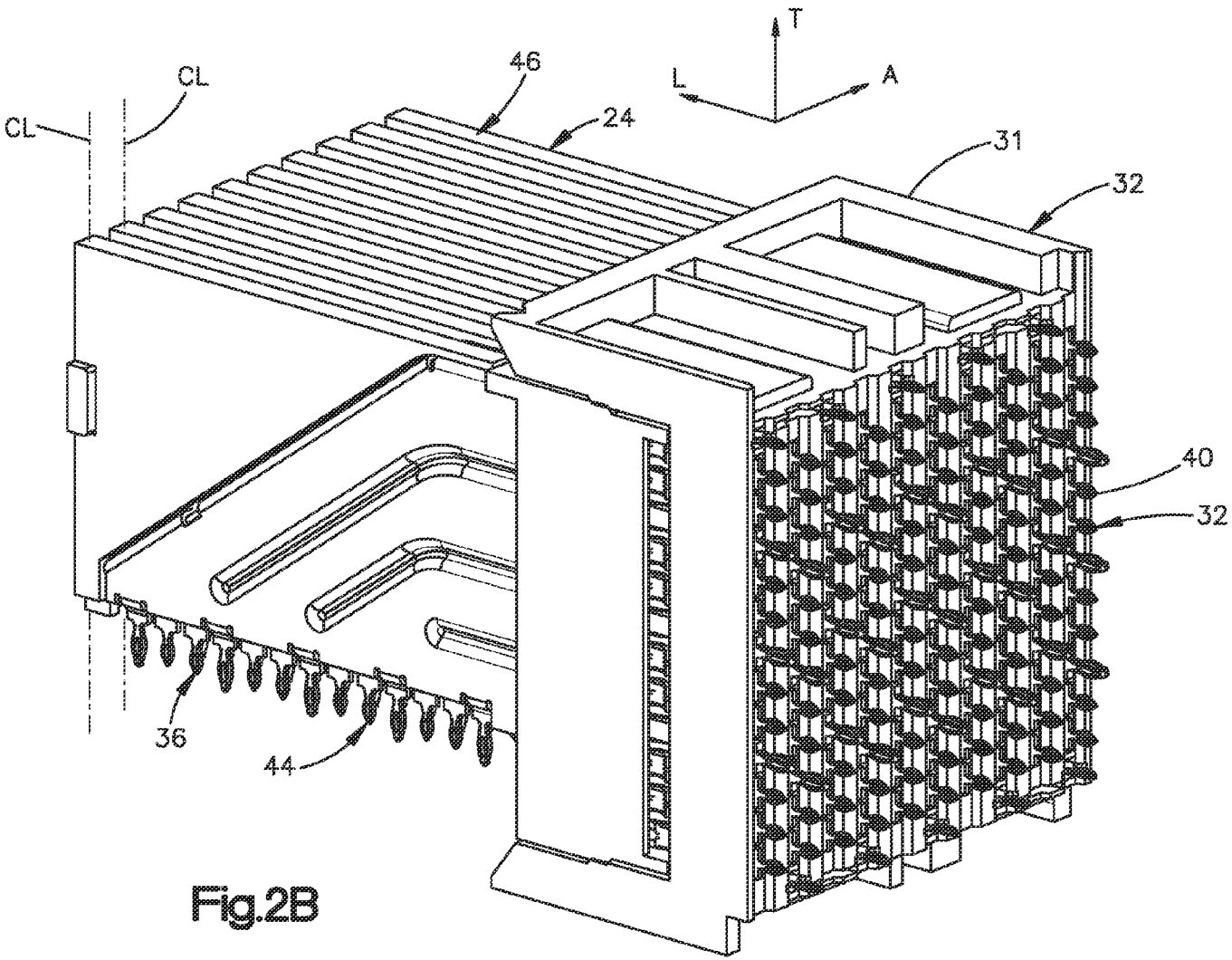
FIG. 2B is another perspective view of the electrical connector assembly as illustrated in FIG. 2A, but showing the electrical connectors in a mated configuration.
Figure 3A:
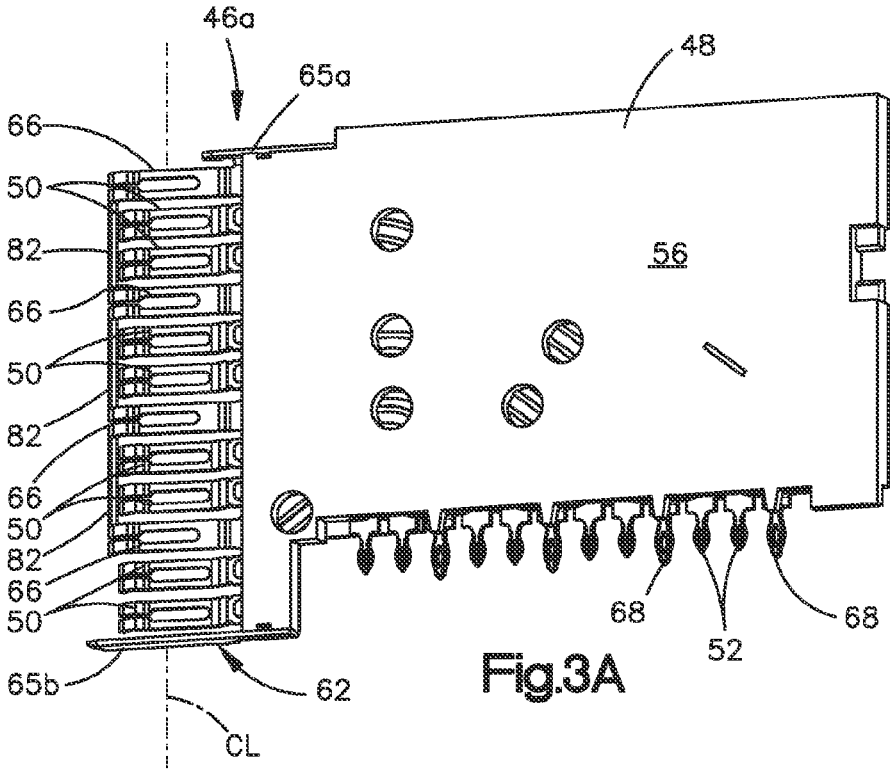
FIG. 3A is a perspective view of one of a first plurality of IMLAs of the right-angle electrical connector illustrated in FIGS. 2A-B.
Figure 3B:
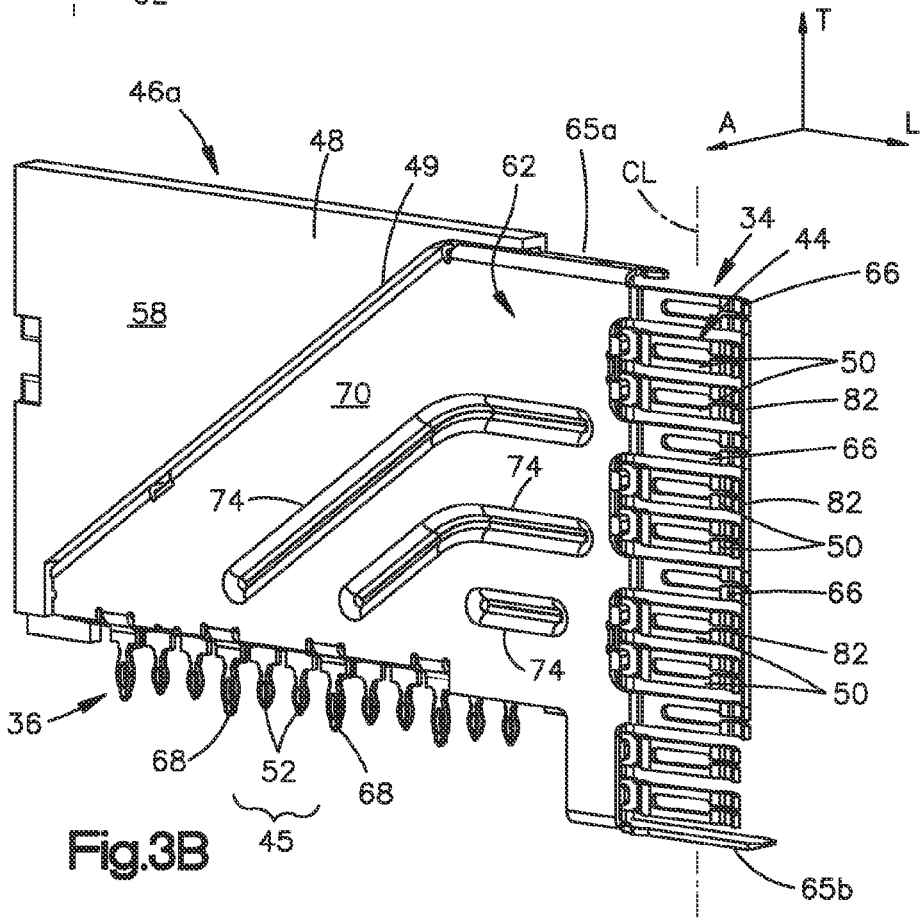
FIG. 3B is another perspective view of the IMLA illustrated in FIG. 3A, showing a ground plate and a plurality of electrical signal contacts.
Figure 3C:
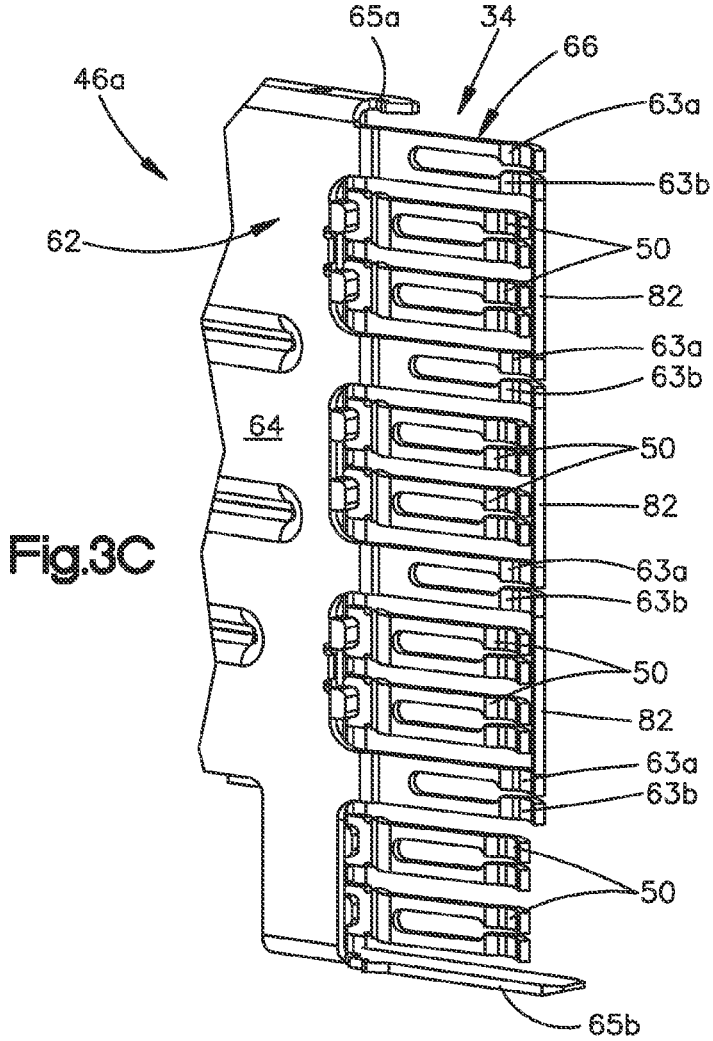
FIG. 3C is an enlarged perspective view of the mating end of the IMLA illustrated in FIG. 3B.
Figure 3D:
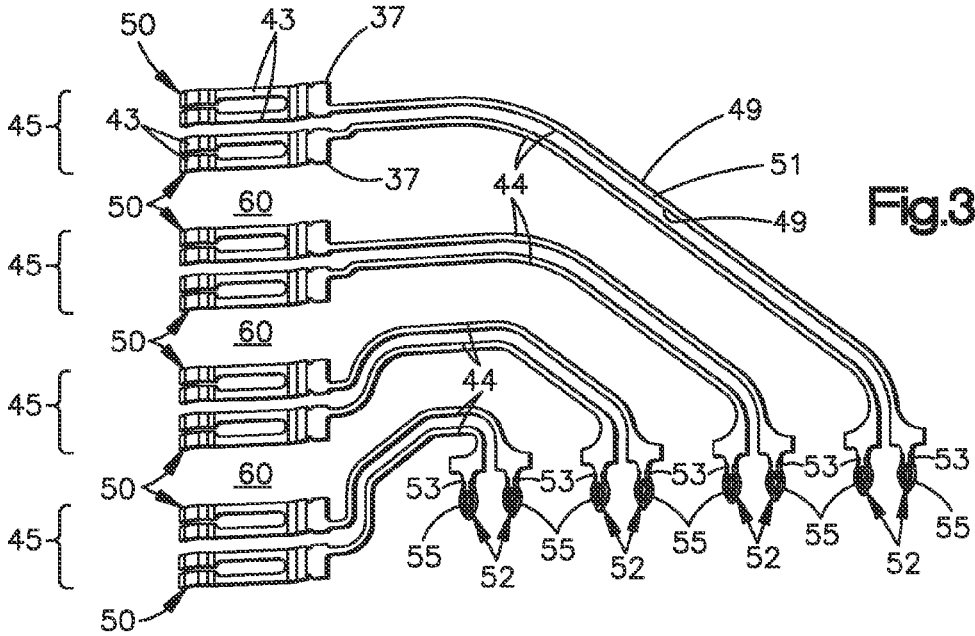
FIG. 3D is a is a perspective view of the electrical signal contacts of the IMLA illustrated in FIG. 3A, arranged as supported by the leadframe housing.

Referring initially to FIGS. 1-2B, an electrical connector assembly 20 includes a first electrical connector 22 and a second electrical connector 24 configured to mate with each other so as to establish an electrical connection between complementary electrical components, such as substrates 26 and 28. In accordance with the illustrated embodiment, each substrate 26 and 28 defines a printed circuit board (PCB). As shown, the first electrical connector 22 can be a vertical connector defining a mating interface 30 and a mounting interface 32 that extends substantially parallel to the mating interface 30. The second electrical connector 24 can be a right-angle connector defining a mating interface 34 and a mounting interface 36 that extends substantially perpendicular to the mating interface 34.

The first electrical connector 22 includes a dielectric housing 31 that carries a plurality of electrical contacts 33, which can include signal contacts and ground contacts. The electrical contacts 33 may be insert molded prior to attachment to the housing 31 or stitched into the housing 31. The electrical contacts 33 define respective mating ends 38 that extend along the mating interface 30, and mounting ends 40 that extend along the mounting interface 32. Each of the electrical contacts 33 can define respective first and second opposed broadsides 39 and first and second edges 41 connected between the broadsides. The edges 41 define a length less than that of the broadsides 39, such that the electrical contacts 33 define a rectangular cross section. The mounting ends 40 may be press-fit tails, surface mount tails, or fusible elements such as solder balls, which are configured to electrically connect to a complementary electrical component such as the substrate 26, which can be configured as a backplane, midplane, daughtercard, or the like.

At least one or more pairs of adjacent electrical contacts 33 can be configured as differential signal pairs 45. In accordance with one embodiment, the differential signal pairs 45 are edge coupled, that is the edges 39 of each electrical contact 33 of a given differential pair 45 face each other along a common column CL. Thus, the electrical connector 22 can include a plurality of differential signal pairs arranged along a given column CL. As illustrated, the electrical connector 22 can include four differential signal pairs 45 positioned edge-to-edge along the column CL, though the electrical connector 22 can include any number of differential signal pairs along a given centerline as desired, such as two, three, four, five, six, or more differential signal pairs.

Because the mating ends 38 of the electrical contacts 33 are configured as plugs, the first electrical connector 22 can be referred to as a plug or header connector. Furthermore, because the mating interface 26 is oriented substantially parallel to the mounting interface 28, the first electrical connector 22 can be referred to as a vertical connector, though it should be appreciated that the first electrical connector can be provided in any desired configuration so as to electrically connect the substrate 28 to the second electrical connector 24. For instance, the first electrical connector 22 can be provided as a receptacle connector whose electrical contacts are configured to receive plugs of a complementary electrical connector that is to be mated. Additionally, the first electrical connector 22 can be configured as a right-angle connector, whereby the mating interface 30 is oriented substantially perpendicular to the mounting interface 32, and co-planar with the mounting interface 32.

Referring now to FIGS. 1-3D, the second electrical connector 24 includes a dielectric housing 42 that retains a plurality of electrical signal contacts 44. In accordance with the illustrated embodiment, the housing 42 retains a plurality of leadframe assemblies 46 that are arranged along a lateral row direction. The plurality of leadframe assemblies 46 can include a first plurality of leadframe assemblies 46*a* each having a first electrical contact arrangement, and a second plurality of leadframe assemblies 46*b* each having a second electrical contact arrangement that differs from the first having a contact arrangement that differs from the first electrical contact arrangement. Alternatively, the leadframe assemblies 46 can be identically constructed or first and second pluralities of leadframe assemblies 46*a* and 46*b* can be arranged in any pattern as desired across the row of leadframe assemblies 46. Each leadframe assembly 46 can be constructed in general as described in U.S. patent application Ser. No. 12/396,086; however one or more up to all of the leadframe assemblies 46 can include a ground plate 62 that replaces discrete ground contacts, as described in more detail below. Each leadframe assembly 46 thus includes a dielectric leadframe housing 48 that carries a plurality of electrical signal contacts 44 arranged along a common transverse column CL. Any suitable dielectric material, such as air or plastic, may be used to isolate the electrical signal contacts 44 from one another.

The electrical signal contacts 44 define a respective receptacle mating ends 50 that extend along the mating interface 34, and opposed mounting ends 52 that extend along the mounting interface 36. Each mating end 50 extends horizontally forward along a longitudinal or first direction L, and each mounting end 52 extends vertically down along a transverse or second direction T that is substantially perpendicular to the longitudinal direction L. The leadframe assemblies 46 are arranged adjacent each other along a lateral or third direction A that is substantially perpendicular to both the transverse direction T and the longitudinal direction L.

Thus, as illustrated, the longitudinal direction L and the lateral direction A extend horizontally as illustrated, and the transverse direction T extends vertically, though it should be appreciated that these directions may change depending, for instance, on the orientation of the electrical connector 24 during use. Unless otherwise specified herein, the terms "lateral," "longitudinal," and "transverse" are used to describe the perpendicular directional components of various components. The terms "inboard" and "inner," and "outboard" and "outer" with respect to a specified directional component are used herein with respect to a given apparatus to refer to directions along the directional component toward and away from the center apparatus, respectively.

The receptacle mounting ends 52 may be constructed similar to the mounting ends 40 of the electrical contacts 33, and thus may include press-fit tails, surface mount tails, or fusible elements such as solder balls, which are configured to electrically connect to a complementary electrical component such as the substrate 28, which can be configured as a backplane, midplane, daughtercard, or the like. The mating ends 50 are configured to electrically connect to the mating ends 38 of the complementary electrical contacts 33 when the electrical connectors 22 and 24 are mated. Each of the electrical signal contacts 44 can define respective first and second opposed broadsides 49 and first and second edges 51 connected between the broadsides 49. The edges 51 define a length less than that of the broadsides 49, such that the electrical signal contacts 44 define a rectangular cross section.

The mating end 50 of each signal contact 44 can include a neck 37 that extends out from the leadframe housing 48 along a longitudinally forward direction. The longitudinally forward direction can also be referred to an insertion or mating direction, as the connectors 22 and 24 can be mated when the electrical connector 24 is brought toward the electrical connector 22 when the electrical connector 24 is brought toward the electrical connector 22 in the longitudinally forward direction. The neck 37 can be laterally curved in a direction toward the outer surface 58 of the leadframe housing 48, so as to be generally aligned with corresponding mating ends 66 of a ground plate 62 (see FIG. 4A) as is described in more detail below. Each signal contact 44 can further include a pair of transversely split fingers 43 that extend longitudinally outward, or forward, from the neck 37. The split fingers 43 can be curved and configured to mate with the mating ends 38 of the electrical contacts 33 of the first electrical connector 22. The split fingers 43 can be flexible, and can flex when mated with the mating ends 38 so as to provide a normal force.

The mounting end 52 of each signal contact 44 can define a neck 53 that extends transversely down from the leadframe housing 48, and a mounting terminal 55 that extends down from the neck 53. The neck 53 and/or the mounting terminal 55 can be angled or curved toward the outer surface 58, and thus toward the ground plate 62. The mounting terminal 55 can define an eye-of-the-needle or any suitable alternative shape configured to electrically connect to the substrate 26. For instance, the mounting terminals 55 can be pressed into vias that extend into the substrate 26 so as to be placed in electrical communication with electrical traces that run along or through the substrate 26.

The electrical signal contacts 44 may define a lateral material thickness of about 0.1 mm to 0.5 mm and a transverse height of about 0.1 mm to 0.9 mm. The contact height may vary over the length of the right angle electrical signal contacts 44. The electrical contacts 44 can be spaced apart at any distance as desired, as described in U.S. patent application Ser. No. 12/396,086. The second electrical connector 24 also may include an IMLA organizer 54 that may be electrically insulated or electrically conductive. The electrical connector 24 can include an electrically conductive IMLA organizer 50 that retains the IMLAs or lead frame assemblies 46.

At least one or more pairs of adjacent electrical signal contacts 44 can be configured as differential signal pairs 45. In accordance with one embodiment, the differential signal pairs 45 are edge coupled, that is the edges 49 of each electrical contact 44 of a given differential pair 45 face each other along a common transverse column CL. Thus, the electrical connector 22 can include a plurality of differential signal pairs 45 arranged along a given column CL. As illustrated, the electrical connector 22 can include four differential signal pairs 45 positioned edge-to-edge along the column CL, though the electrical connector 24 can include any number of differential signal pairs along a given centerline as desired, such as two, three, four, five, six, or more differential signal pairs.

Because the mating ends 50 and the mounting ends 52 are substantially perpendicular to each other, the electrical signal contacts 44 can be referred to as right-angle electrical contacts. Similarly, because the mating interface 30 is substantially parallel to the mounting interface 32, the second electrical connector 24 can be provided as a vertical header connector. Moreover, because the mating ends 50 are configured to receive the mating ends 38 of the complementary electrical contacts 33 configured as plugs, the electrical signal contacts 44 can be referred to as receptacle contacts. It should be appreciated, however, that the second electrical connector 24 can be provided in any desired configuration so as to electrically connect the substrate 28 to the first electrical connector 22. For instance, the second electrical connector 24 can be configured as a header connector, and can be further be configured as a vertical connector as desired. When the connectors 22 and 24 are mounted to their respective substrates 26 and 28 and mated with each other, the substrates 26 and 28 are placed in electrical communication.

The first and second electrical connectors 22 and 24 may be shieldless high-speed electrical connectors, i.e., connectors that operate without metallic crosstalk plates between adjacent columns of electrical contacts, and can transmit electrical signals across differential pairs at data transfer rates at or above four Gigabits/sec, and typically anywhere at or between 6.25 through 12.5 Gigabits/sec or more (about 80 through 35 picosecond rise times) with acceptable worst-case, multi-active crosstalk on a victim pair of no more than six percent. Worst case, multi-active crosstalk may be determined by the sum of the absolute values of six or eight aggressor differential signal pairs that are closest to the victim differential signal pair, as described in U.S. Pat. No. 7,497,736. Each differential signal pair may have a differential impedance of approximately 85 to 100 Ohms, plus or minus 10 percent. The differential impedance may be matched, for instance, to the respective substrates 26 and 28 to which the electrical connectors 22 and 24 may be attached. The connectors 22 and 24 may have an insertion loss of approximately −1 dB or less up to about a five-Gigahertz operating frequency and of approximately −2 dB or less up to about a ten-Gigahertz operating frequency.

With continuing reference to FIGS. 3A-3D, the leadframe housing 48 of each leadframe assembly 46 defines laterally opposed outer surfaces 56 and 58. The leadframe housing 48 can be made of any suitable dielectric material such as plastic, and carries the right-angle electrical signal contacts 44. The leadframe assemblies 46 can be configured as insert molded leadframe assemblies, whereby the electrical signal contacts 44 are overmolded by the leadframe housing 48 in accordance with the illustrated embodiment. Alternatively, the electrical signal contacts 44 of the leadframe assemblies 46 can be stitched or otherwise attached in the leadframe housing 48. Each electrical signal contact 44 defines a mating end 50 and a mounting end 52 as described above. The mating ends 50 are aligned along the transverse direction T, and the mounting ends 52 are aligned along the longitudinal direction L. The signal contacts 44 are arranged in pairs 45, which can be differential signal pairs. Alternatively, the signal contacts 44 can be provided as single-ended signal contacts. Selected ones of the signal contacts 44, such as one or more up to all of adjacent pairs 45 of signal contacts 44, are separated by a gap 60. The electrical signal contacts 44 are further disposed in the leadframe housing 48 such that the gap 60 spaces the upper electrical signal contact 44 from the upper end of the leadframe 46*a*.

Figure 4A:
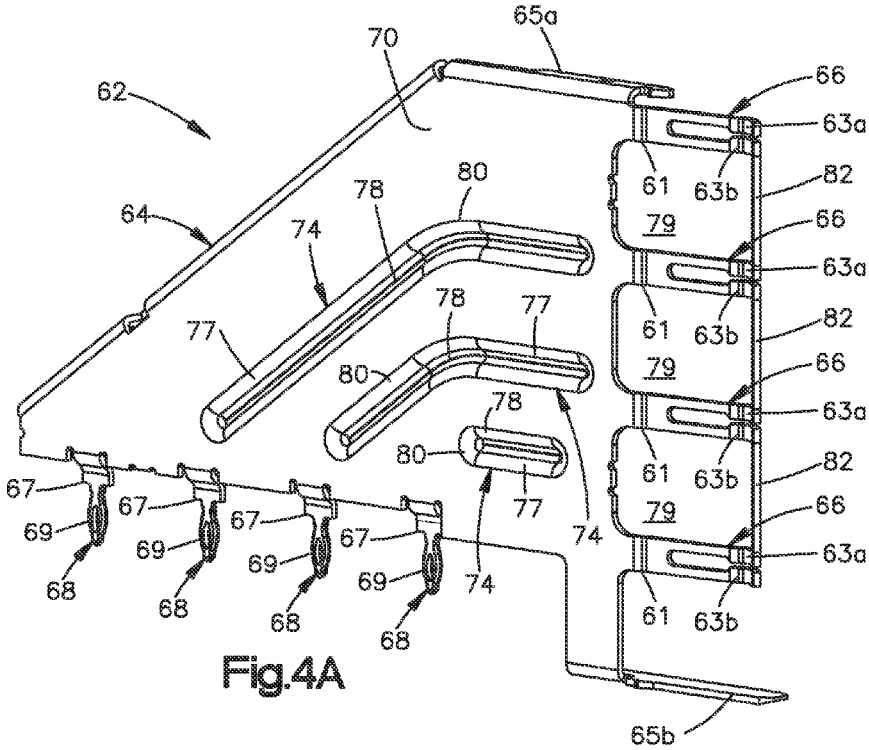
FIG. 4A is a perspective view of the ground plate illustrated in FIG. 3B.
Figure 4B:
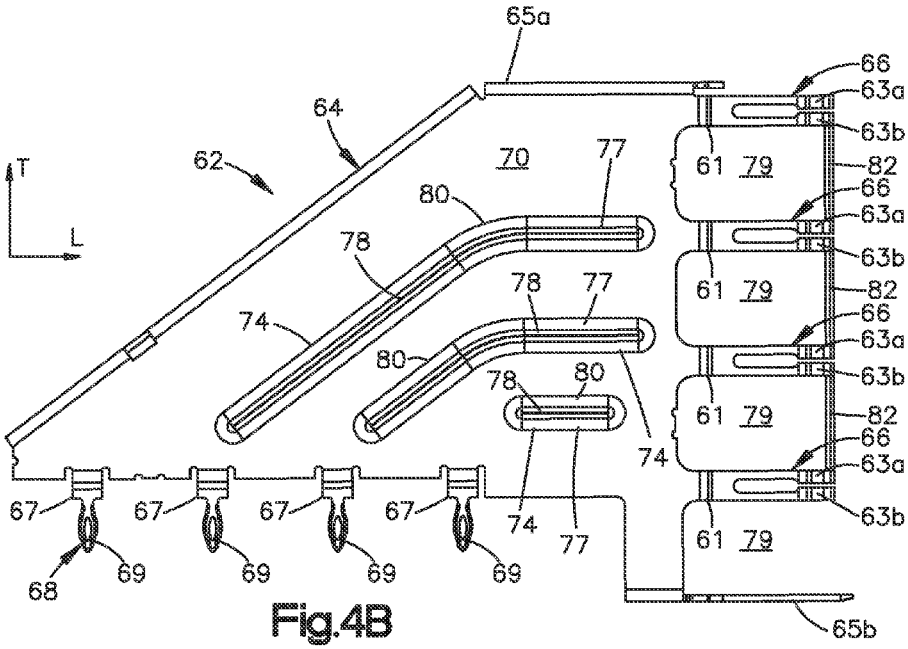
FIG. 4B is a side elevation view of the ground plate illustrated in FIG. 4A.
Figure 4C:
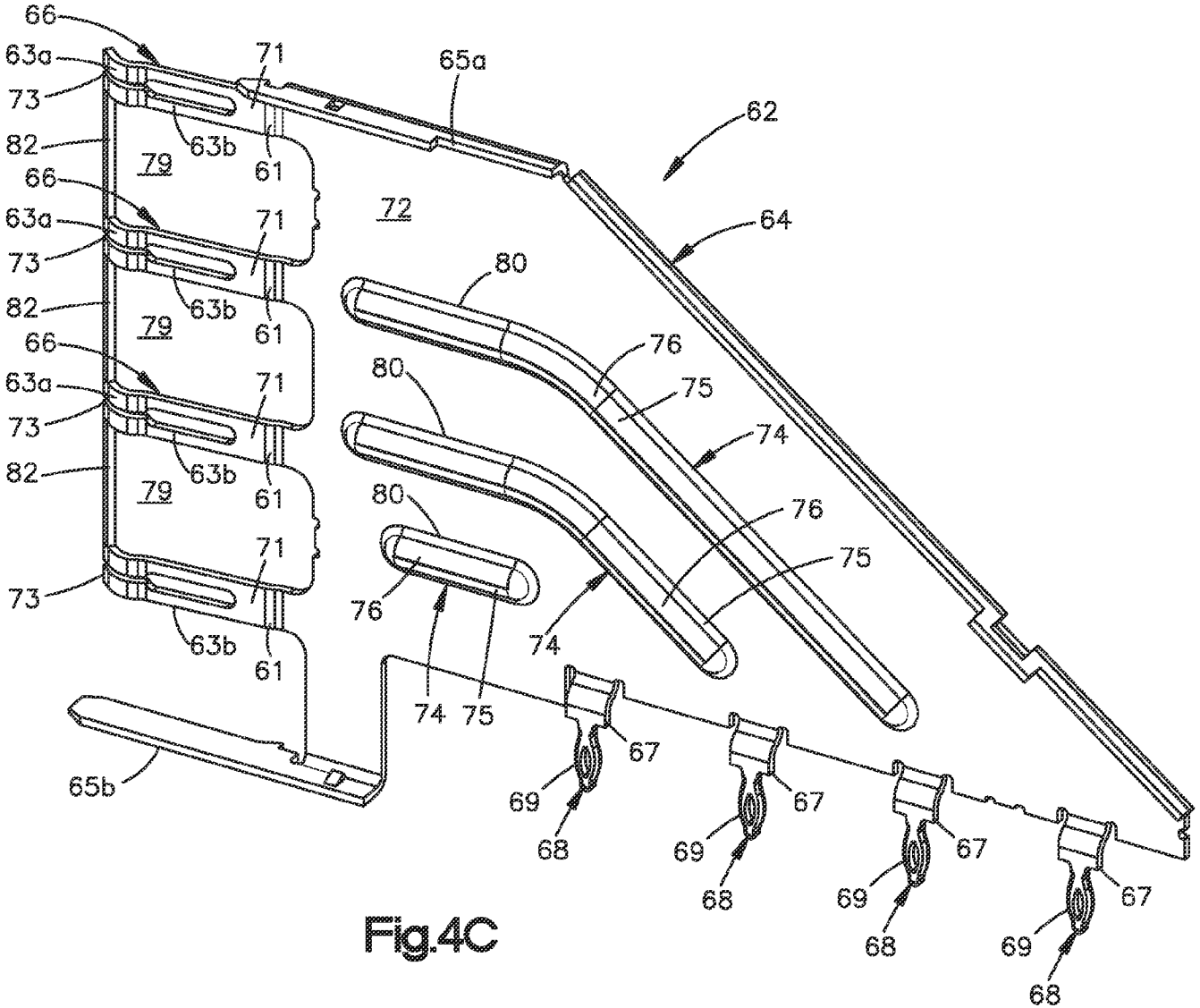
FIG. 4C is another perspective view of the ground plate illustrated in FIG. 4A.

Referring also to FIGS. 4A-C, each leadframe assembly 46 further includes a ground plate 62 that is carried by the leadframe housing 48. The ground plate 62 defines ground mating ends 66 that are configured to mate with complementary ground contacts of the electrical connector 22, and opposed ground mounting ends 68 that are configured to connect to the substrate 26. The ground plate 62 defines a plurality of gaps 79 disposed between adjacent mating ends 66. The ground plate 62 is further configured to provide an electrical shield between differential signal pairs 45 of adjacent columns CL. The ground plate 62 can be formed from any suitable electrically conductive material, such as a metal, and includes a body 64, a plurality of mating ends 66 extending forward from the body 64, and a plurality of mounting ends 68 extending down from the body. The mating ends 66 and mounting ends 68 can be constructed as described above with respect to the mating ends 50 and mounting ends 52 of the electrical signal contacts 44. The ground plate 62 of each leadframe assembly 46 can be discretely attached to the leadframe housing 48 or overmolded by the leadframe housing 48 of the respective leadframe assembly 46.

With continuing reference to FIGS. 3A-4C, each mating end 66 of the ground plate 62 can include a neck 61 that extends longitudinally forward from the body 64. The neck 61 can be laterally curved in a direction toward the signal contacts 44 of the leadframe assembly 46, such that the mating ends 66 are generally aligned with the corresponding mating ends 50 of the signal contacts 44. Accordingly, the mating ends 66 and 50 are configured to mate with the mating ends 38 of the electrical contacts of the complementary first electrical connector 22. Each mating end 66 of the ground plate 62 can further include a pair of transversely split fingers including a first or upper finger 63*a* and a second or lower finger 63*b* that each extends longitudinally forward, from the neck 61. The fingers 63*a* and 63*b* can be curved and configured to mate with the mating ends 38 of the electrical contacts 33. The fingers 63*a* and 63*b* can be flexible so as to flex when mated with the mating ends 38 so as to provide a normal force. The fingers 63*a* and 63*b* can extend further longitudinally forward than the fingers 43 of the electrical signal contacts 44. Each mating end 66 defines a distal end 71 that extends out from the ground plate body 64, and opposed distal tips 73 of each of the fingers 63*a* and 63*b*.

Each mounting end 52 of the ground plate 62 can define a neck 67 that extends transversely down from the body 64, and a mounting terminal 69 that extends down from the neck 67. The neck 67 and/or the mounting terminal 69 can be angled or curved toward the electrical contacts 44. The mounting terminals 69 can define an eye-of-the-needle or any suitable alternative shape configured to electrically connect to the substrate 26. For instance, the mounting terminals 69 can be pressed into vias that extend into the substrate 26 so as to be placed in electrical communication with electrical traces that run along or through the substrate 26.

Referring now also to FIGS. 4A-4C, the body 64 of the ground plate 62 defines a first outer surface 72 and a second outer surface 70 that is laterally opposed with respect to the inner surface 72. The second outer surface 70 can be flush with, can protrude past, or can be inwardly recessed with respect to the corresponding outer surface 58 of the leadframe housing 48. Accordingly, the dimensions of the electrical connector 24 can remain unchanged with respect to electrical connectors whose IMLAs carry discrete ground contacts, for instance as described in U.S. Pat. No. 7,497,736, the disclosure of which is hereby incorporated by reference as if set forth in its entirety herein. The first outer surface 72 faces the electrical signal contacts 44 of the leadframe assembly 46. The ground plate 62 can include an engagement member, such as a first lip 65*a* that fits into a slot 49 (FIG. 3B) that extends laterally into the outer surface 58 of the leadframe housing 48, and a second lip 65*b* that fits over the leadframe housing 48 so as to capture the leadframe housing 48 and the ground plate 62.

The ground plate 62 can be electrically conductive, and thus configured to reflect electromagnetic energy produced by the signal contacts 44 during use, though it should be appreciated that the ground plate 62 could alternatively be configured to absorb electromagnetic energy. For instance the ground plate 62 can be made from one or more ECCOSORB® absorber products, commercially available fro Emerson & Cuming, located in Randolph, Mass. The ground plate 62 can alternatively be made from one or more SRC PolyIron® absorber products, commercially available from SRC Cables, Inc, located in Santa Rosa, Calif. Furthermore, because the ground plates 62 are disposed between the signal contacts 44 of adjacent leadframe assemblies 46, the ground plates 62 can provide a shield between differential signal pairs 45 of adjacent columns CL that reduces cross-talk between the signal contacts 44 of adjacent leadframe assemblies 46.

The mating ends 66 of the ground plate 62 define ground mating ends, and are aligned along the transverse direction T, and are further aligned with the mating ends 58 of the signal contacts 44 along the transverse direction T. The mating ends 66 of the ground plate 62 can be longitudinally outwardly offset with respect to the mating ends 58 of the signal contacts 44. The mounting ends 68 are aligned along the longitudinal direction L, and are aligned with the mounting ends 52 along the longitudinal direction L. The mating ends 66 are positioned adjacent and/or between the pairs 45 of the mating ends 50 of the signal contacts, and the mounting ends 68 are positioned adjacent and/or between pairs of mounting ends 52. Thus, the mating interface 34 of the electrical connector 24 includes both the mating ends 50 of the electrical signal contacts 44 and the mating ends 66 of the ground plate 62, and the mounting interface 36 of the electrical connector 24 includes both the mounting ends 52 of the electrical signal contacts 44 and the mounting ends 66 of the ground plate 62.

In accordance with the illustrated embodiment, when the ground plate 62 is attached to the leadframe housing 48, the mating ends 66 are disposed between a pair of mating ends 50 of adjacent electrical signal contacts 44. The mating ends 66 can thus be are thus disposed in the gap 60 between the mating ends 50 of adjacent differential signal pairs 45, such that the mating ends 50 and 66 are equidistantly spaced along the mating interface 34 of the electrical connector 24. Likewise, the mounting ends 68 of the ground plate 62 are disposed in the gap 60 that extends between them mounting ends 52 of adjacent signal pairs 45, such that the mounting ends 68 and 52 are equidistantly spaced along the mounting interface 36 of the electrical connector 24.

The first plurality of leadframe assemblies 46*a* can be constructed identically, and configured such that when the ground plate 62 is attached to the leadframe housing 48, the mating interface 34 of at least one up to all of the leadframe assemblies 46*a* are arranged in a first pattern of mating ends 50 and 66. In accordance with the illustrated embodiment, the first contact arrangement is a repeating G-S-S pattern, whereby "G" identifies the mating end 66 the ground plate 62, and "S" identifies the mating end 50 of an electrical signal contact 44, and the two adjacent "S"s in the repeating G-S-S can identify a differential signal pair 45. Because the mating ends 66 and 50 are arranged in a repeating G-S-S pattern from the top of the mating interface 34 in a downward direction toward the mounting interface 36 along the respective column CL, the IMLA 26*a* and corresponding mating ends 50 and 66 can be said to define a repeating G-S-S pattern. The mounting ends 52 and 68 are therefore likewise arranged in the repeating G-S-S pattern from the rear end of the leadframe assembly 46*a* in a longitudinal direction toward the front end, or mating interface 34, of the leadframe assembly 46*a*

Figure 5A:
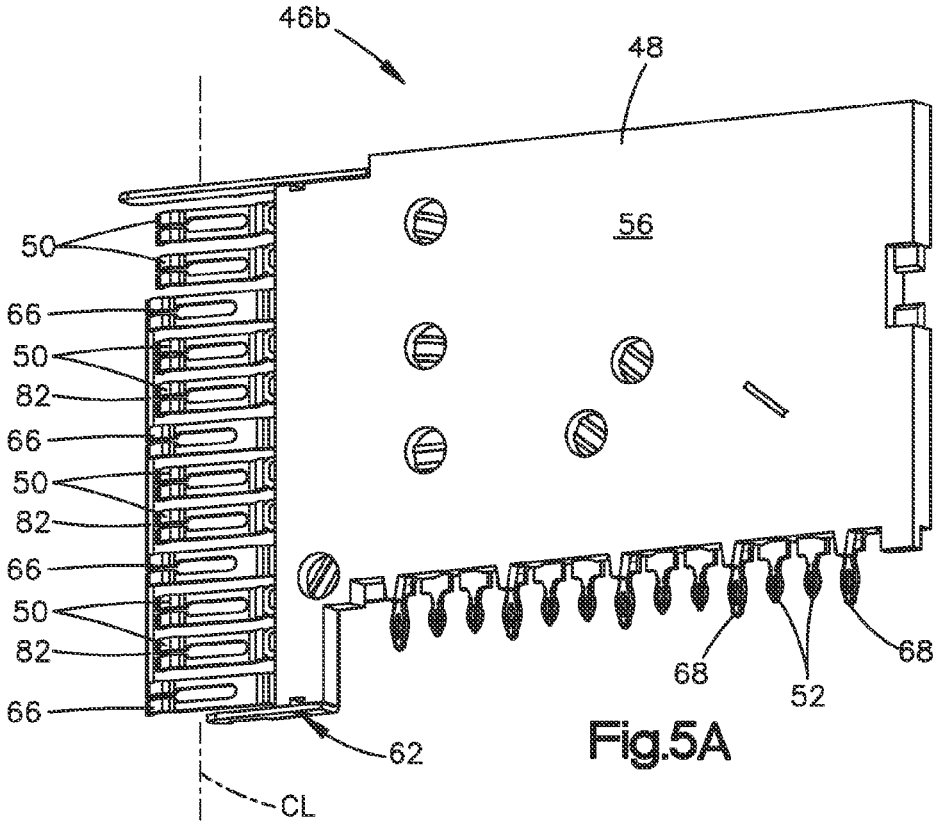
FIG. 5A is a perspective view of one of a second plurality of IMLAs of the right-angle electrical connector illustrated in FIGS. 2A-B.
Figure 5B:
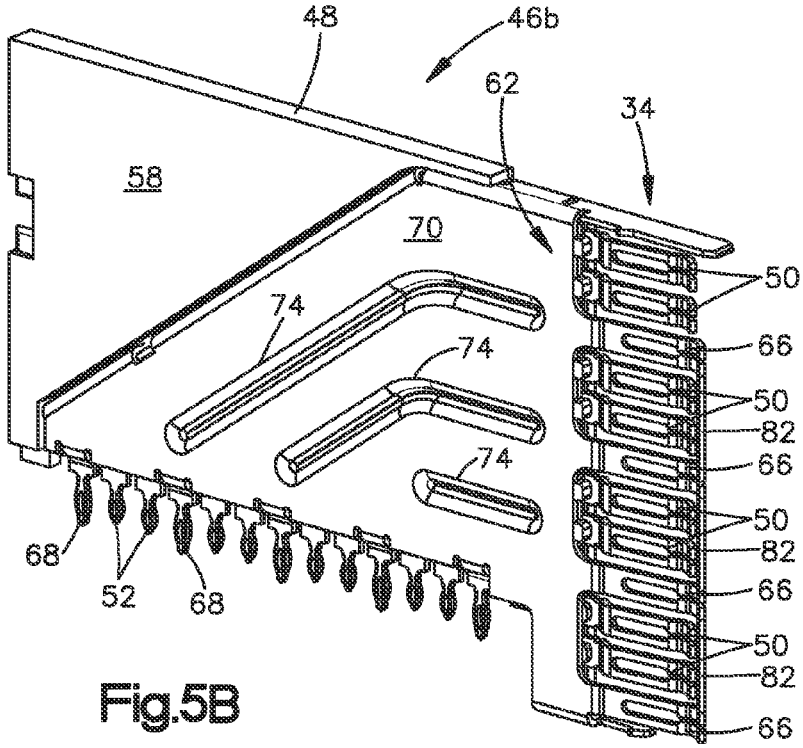
FIG. 5B is another perspective view of the IMLA illustrated in FIG. 5A, showing a ground plate and a plurality of electrical signal contacts.
Figure 5C:
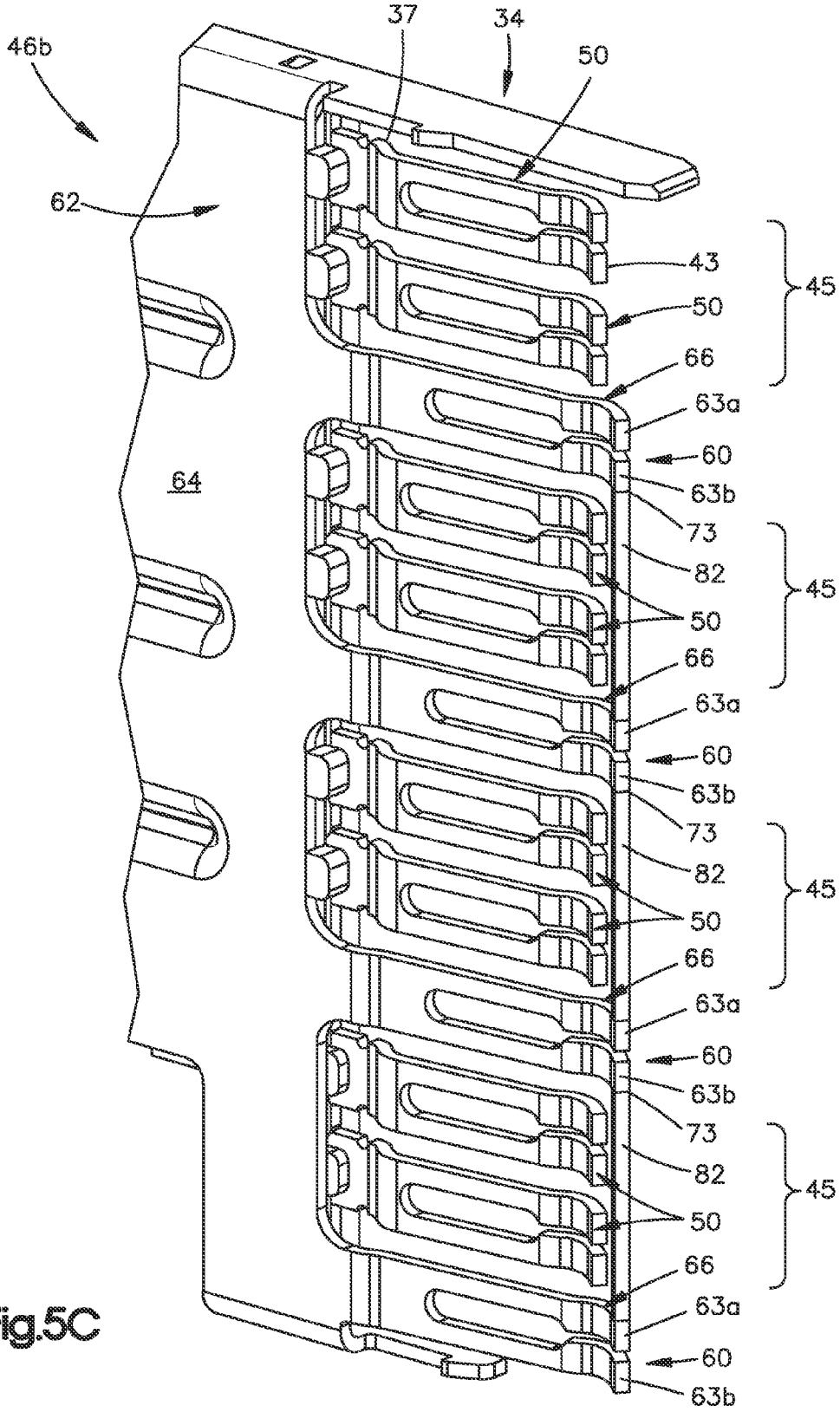
FIG. 5C is an enlarged perspective view of the mating end of the IMLA illustrated in FIG. 5A.
Figure 5D:
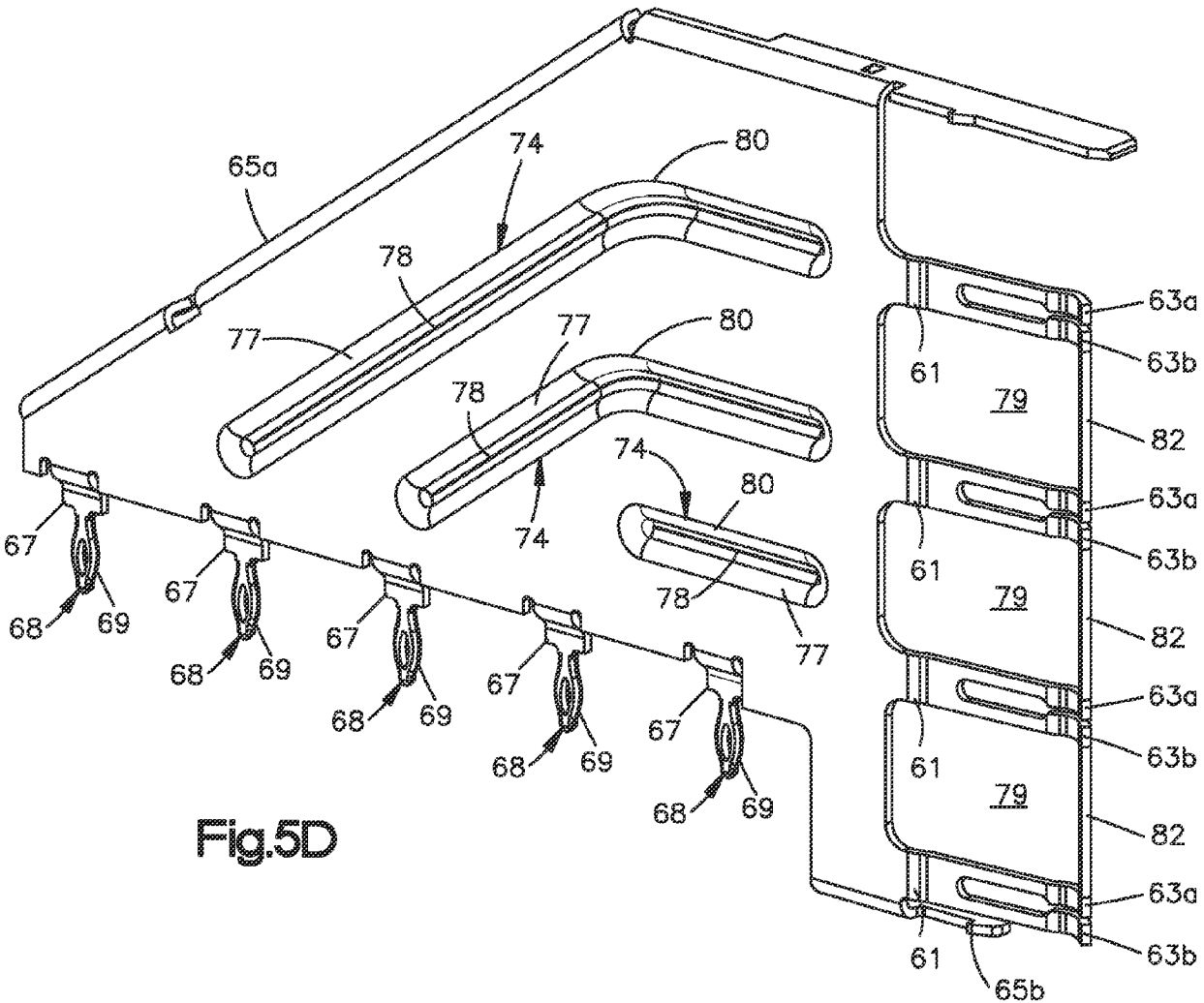
FIG. 5D is a perspective view of the ground plate illustrated in FIG. 5B.

As illustrated in FIG. 5C, the second leadframe assemblies 46*b* can be constructed identically, and configured such that when the ground plate 62 is attached to the leadframe housing 48, the mating interface 34 of at least one up to all of the IMLAs 26*b* is arranged in a second pattern of mating ends 50 and 66. In accordance with the illustrated embodiment, the second contact arrangement is a repeating S-S-G pattern, whereby "G" identifies the mating end 66 the ground plate 62, and "S" identifies the mating end 50 of an electrical signal contact 44, and the two adjacent "S"s in the repeating S-S-G pattern can identify a differential signal pair 45. Because the mating ends 66 and 50 are arranged in a repeating S-S-G pattern from the top of the mating interface 34 in a downward direction toward the mounting interface 36 along the respective column CL, the IMLA 26*a* and corresponding mating ends 50 and 66 can be said to define a repeating S-S-G pattern. The mounting ends 52 and 68 are therefore likewise arranged in the repeating S-S-G pattern from the rear end of the leadframe assembly 46*b* in a longitudinal direction toward the front end, or mating interface 34, of the leadframe assembly 46*b* It should thus be appreciated that the first and second patterns can define any pattern of ground and signal contacts (e.g., mating/mounting ends) as desired, and can further define the same pattern such that all Leadframe assemblies 46 are identically constructed.

Referring now to FIGS. 4A-C, the ground plate 62 can include at least one rib 74, such as a plurality of ribs 74 supported by the plate body 64. The ribs 74 can be constructed as described in U.S. patent application Ser. No. 12/722,797, the disclosure of which is incorporated by reference as if set forth in its entirety herein. In accordance with the illustrated embodiment, each rib 74 is stamped or embossed into the body 64, and is thus integral with the body 64. Thus, the ribs 74 can further be referred to as embossments. As illustrated, each rib 74 defines a first surface 75 that defines a projection 76 that extends laterally inwardly (e.g., into the leadframe housing 48 of the leadframe assembly 46) from the outer surface 72, and an opposed second surface 77 that defines a corresponding embossment 78 or recessed surface that extends into the outer surface 70 of the ground plate body 64. Otherwise stated, the body 64 includes a plurality of projections 76 projecting laterally from the outer surface 72, and further includes a plurality of embossments 78, corresponding to the plurality of projections 76, recessed in the outer surface 70. The projections 76 can extend inward to a depth so as to be aligned with the electrical signal contacts 44 that are carried by the leadframe housing 48. The ribs 74 are positioned so as to be disposed equidistantly between adjacent differential signal pairs 45 inside the leadframe housing. The ribs 74 define respective enclosed outer perimeters 80 that are spaced from each other along the ground plate body 64. Thus, the ribs 74 are fully contained in the plate body 64.

The ground plate 64 can be retained by the leadframe housing 48 at a position such that the mating ends 63 of the ground plate 64 are be disposed between the mating ends 50 of adjacent differential signal pairs 45. The ground plates 62 can be inserted into the leadframe housing 48, overmolded by the leadframe housing 48, or otherwise carried or retained by the leadframe housing 48 such that the dimensions of the leadframe assembly 48 are substantially equal to those of conventional leadframe assemblies that contain discrete signal contacts and ground contacts overmolded by or otherwise coupled to a leadframe housing. The ground plate body 64 spans across a portion of a plurality up to all of the differential signal pairs 45 that is disposed in the leadframe housing 48. The leadframe assemblies 46 do not include discrete ground contacts, but rather includes the ground plate 62 that provides a low-impedance common path to intercept and dissipate stray electro-magnetic energy that otherwise would have been a source for cross talk between the electrical signal contacts 44 of adjacent leadframe assemblies 48. The ground plate 48 can be configured to reflect electromagnetic energy produced by the signal contacts 44 during use, though it should be appreciated that the plate could alternatively be configured to absorb electromagnetic energy. For instance, the ground plates 62 can be made of any lossy material, conductive or nonconductive.

Referring to FIGS. 3A-4C, each ground plate 62 can include at least one ground coupling beam 82 that is connected between at least a select pair of mating ends 66. Thus, the ground coupling beam 82 can be connected between a first and second mating end 66 that is each disposed between adjacent electrical signal contacts 44, and in particular between adjacent differential signal pairs 45. Furthermore, a pair of electrical signal contacts 44, such as a differential signal pair 45, is disposed between the first and second mating ends 66 that are connected by the ground coupling beam 82. In accordance with the illustrated embodiment, the leadframe assembly 46 includes a plurality of ground coupling beams 82. Each ground coupling beam 82 is connected between adjacent mating ends 66, and is conductive so as to place the adjacent mating ends in electrical communication through the ground coupling beam 82. In particular, each ground coupling beam 82 is connected between one but not both of the fingers 63*a* and 63*b* of a given mating end 66. For instance, each ground coupling beam 82 is connected to the lower finger 63*b* of a first or upper mating end 66 and the upper finger 63*a* of a second or lower mating end 66. It should be appreciated, however that one or more of the ground beams 82 can be connected between the fingers 63*a* and 63*b* of adjacent mating ends 66, and can further be connected between the fingers 63*a* and 63*b* of a given mating end 66 as desired. Thus, at least one of the ground beams 82 can be connected to as many mating ends 66 as desired, up to all of the mating ends 66 of the ground plate 62. The ground coupling beams 82 can be integral with or discretely connected to the mating ends 66 as desired.

The mating ends 66 of the ground plates 62 can be sized such that the fingers 63*a* and 63*b* extend further longitudinally forward than the fingers 43 of the electrical signal contacts 44. Thus, the ground coupling beams 82 can be connected to the fingers 63*a* and 63*b* along a straight transverse direction, parallel to the column CL, between the fingers 63*a* and 63*b* of adjacent mating ends 66 at a longitudinal location that is spaced forward from the fingers 43 of the electrical signal contacts 44, such that the ground coupling beams 82 are electrically isolated from the electrical signal contacts 44. In accordance with the illustrated embodiment, the ground coupling beams 82 are connected to the distal tips 73 of the fingers 63*a* and 63*b*, such that the fingers 63*a* and 63*b* do not extend longitudinally beyond the ground coupling beams 82.

It should be appreciated, however, that the ground coupling beams 82 can be connected to any location of the mating ends 66 as desired. For instance, the ground coupling beams 82 can be connected to the mating ends 66 at locations that are aligned with the mating ends 50 of the electrical signal contacts 44, and can extend along a direction angularly offset with respect to the transverse direction (e.g., curved or bent) so as to avoid contact with the mating ends 50 of the electrical signal contacts 44. For instance, the distal tips 73 of the fingers 63*a* and 63*b* can be in-line with the distal ends of the fingers 43 of the electrical signal contacts 44. Each ground coupling beam 82 can define any cross sectional shape as desired, such as circular, rectangular, square, or any alternative shape.

Thus, the electrical connector 24 includes a plurality of electrical signal contacts 44 retained by the leadframe housing 48 and thus the dielectric housing 42. The electrical signal contacts 44 define mating ends 50 and opposed mounting ends 52. The electrical connector 24 further includes the ground plate 62 having the body 64, and at least a first mating end 66 and at least a second mating end 66 that extends out from the body 64 at a location such that the mating end 50 of at least one of the electrical signal contacts 44 is disposed between the first and second mating ends 66 of the ground plate 62. In accordance with the illustrated embodiment, the mating ends 50 of a pair of the electrical signal contacts 44, such as a differential signal pair 45, is received in a gap 79 disposed between the first and second mating ends 66 of the ground plate 62. The ground plate 62 further includes a third mating end 66 that extends out from the body 64 at a location such that the mating end of at least a second electrical signal contact 44, such as a pair of electrical signal contacts 44, or a differential signal pair 45, is received in a gap 79 disposed between the second and third mating ends 66. The ground plate 62 includes a first ground coupling beam 82 connected between the first and second mating ends 66, and a second ground coupling beam 82 connected between the second and third mating ends 66. Furthermore, because the first and second ground coupling beams 82 are connected between split fingers 63*a* and 63*b* of the second mating end 66 that are spaced from each other, the first and second ground coupling beams 82 are isolated from each other so that an electrical path established along the first and second ground coupling beams 82 does not travel directly from the first ground coupling beam 82 to the second ground coupling beam, but rather travels from the first ground coupling beam 82, along the second mating end, and into the second ground coupling beam 82.

Without being bound by theory, it is believed that connected mating ends 66 of the ground plate 62 allows fields of opposite polarity generated during use mix and cancel each other out, thereby "resetting" the ground. Accordingly, it is desired to shorten the length of unconnected ground paths. As described in U.S. patent application Ser. No. 12/393,794, it is appreciated that shortening the longest uncoupled electrical ground path length in the electrical connector assembly 20 when the two connectors 22 and 24 are mated can likewise shift the resonance frequency upwards so as to allow for a greater working bandwidth during operation. Because the ground paths are coupled at the substrate 28 to which the electrical connector 24 is mounted, and further at the ground plate body 64, the grounds reset at those locations. The mating ends 66 of the ground plate 62 and the mating ends 48 of the complementary electrical contacts 33 of the first electrical connector 22 also define an electrical ground path length. By positioning the ground coupling beam 82 at the mating ends 66 of the ground plate 62, the electrical ground path length at the mating interface 34 of the electrical connector 24 is shortened, thereby increasing the resonance frequency of the electrical connector 24 in the manner described above.

Accordingly, the electrical connector 24 is believed to provide an improvement over shieldless, high density, right-angle electrical connectors that have discrete ground contacts while at the same time avoiding a reduction in impedance matching without significantly increasing inductance. In accordance with one embodiment, a conventional electrical connector is modified by removing the discrete ground contacts and replacing the discrete ground contacts with the ground plate 62. Thus, the pre-modified electrical connector is substantially identical to the electrical connector 24 but for the removal of the discrete ground contacts and the addition of the ground plate 82. The ground plate 62 that has mating ends 66 and mounting ends 68 portions that align with the respective mating ends 50 and mounting ends 52 of the electrical signal contacts 44. In accordance with one aspect of the present disclosure, impedance is not significantly altered with respect to a pre-modified connector, inductance is lower than the ground contacts in the same pre-modified connector, crosstalk is lower as compared to the same pre-modified connector, and the overall dimensions of the pre-modified connector are substantially the same as those of the electrical connector 24.

As described above with reference to FIG. 2A, the electrical connector 24 includes a plurality of leadframe assemblies 46 that includes a first plurality of leadframe assemblies 46*a* and a second plurality of leadframe assemblies 46*b* that are alternatingly arranged along the lateral row direction across the electrical connector 24. Referring now to FIGS. 5A-C, each of the second plurality of leadframe assemblies 46*b* is constructed as described above with respect to the first plurality of leadframe assemblies 46*a*, however the second plurality of leadframe assemblies 46*b* defines a second electrical contact arrangement that differs from the first electrical contact arrangement of the first plurality of leadframe assemblies 46*a*.

The ground plate 62 of the second leadframe assemblies 46*b* is configured such that the mating ends 66 are disposed in the gap 60 when overmolded by or otherwise connected to the leadframe housing 48 of the second leadframe assembly 46*b*. Accordingly, each of the second plurality of leadframe assemblies 46*b* defines a contact arrangement in the repeating S-S-G pattern as described above.

It should thus be appreciated a plurality of ground plates 62 can be provided, such that at least a first ground plate 62 corresponding to a leadframe assembly of the first plurality of leadframe assemblies 46*a* is constructed differently than the at least a second ground plate 62 corresponding to a leadframe assembly of the second plurality of leadframe assemblies 64*b*. In particular, the mating ends 66 of the ground plates 62 of the second plurality of leadframe assemblies 46*b* extend from a location of the respective body 46 that is different than the location of the body 46 from which the mating ends 66 of the ground plates 62 of the first plurality of leadframe assemblies 46*a* extend. In accordance with the illustrated embodiment, the mating ends 66 of a first plurality of ground plates 62 (e.g., of the first plurality of leadframe assemblies 46*a*) are transversely offset with respect to the mating ends of a second one or a plurality of ground plates 62 (e.g., of the second plurality of leadframe assemblies 46*b*). Thus, a plurality of ground plates 62 can include a first ground plate and a second ground plate that is constructed differently than the first ground plate as described above.

The foregoing description is provided for the purpose of explanation and is not to be construed as limiting the invention. While various embodiments have been described with reference to preferred embodiments or preferred methods, it is understood that the words which have been used herein are words of description and illustration, rather than words of limitation. Furthermore, although the embodiments have been described herein with reference to particular structure, methods, and embodiments, the invention is not intended to be limited to the particulars disclosed herein. Additionally, it should be understood that the concepts described above with the above-described embodiments may be employed alone or in combination with any of the other embodiments described above. Those skilled in the relevant art, having the benefit of the teachings of this specification, may effect numerous modifications to the invention as described herein, and changes may be made without departing from the spirit and scope of the invention as defined by the appended claims.

What is claimed:

1. An electrical connector comprising:

an insulative housing, a plurality of electrical signal contacts carried by the housing, the electrical signal contacts each defining mating ends and opposed respective mounting ends; and a ground plate having a body and at least a first mating end and a second mating end that each extend out from the body at a location such that the mating end of at least one of the plurality of electrical signal contacts is disposed between the first and second mating ends of the ground plate, the ground plate further including a ground coupling beam connected between the first and second mating ends of the ground plate and isolated from the mating end of the at least one of the plurality of electrical signal contacts.

2. The electrical connector as recited in claim 1, wherein the plurality of electrical signal contacts comprises a differential signal pair and the mating ends of the electrical signal contacts of the differential signal pair are disposed between the first and second mating ends of the ground plate.

3. The electrical connector as recited in claim 1, wherein the ground plate further comprises a third mating end that extends out from the body at a location such that the mating end of at least a second electrical signal contact is disposed between the second and third mating ends.

4. The electrical connector as recited in claim 3, wherein the ground coupling beam is a first ground coupling beam, and the electrical connector further comprises a second ground coupling beam that is connected between the second and third mating ends of the ground plate and is isolated from the second electrical signal contact.

5. The electrical connector as recited in claim 4, wherein the first ground coupling beam is isolated from the second ground coupling beam.

6. The electrical connector as recited in claim 5, wherein the first and second mating ends of the ground plates include a pair of spaced fingers, such that one of the pair of spaced fingers is connected to the first ground coupling beam and the other of the pair of spaced fingers is connected to the second ground coupling beam.

7. The electrical connector as recited in claim 1, wherein the first and second mating ends of the ground plate extends out from the body to a location forward with respect to the mating end of the electrical signal contacts.

8. The electrical connector as recited in claim 1, wherein the ground coupling beam is connected between the first and second mating ends of the ground plate at a location forward of the mating end of the at least one of the plurality of electrical signal contacts.

9. The electrical connector as recited in claim 1, wherein the housing is overmolded onto the plurality of electrical signal contacts.

10. The electrical connector as recited in claim 1, wherein the ground plate is electrically conductive.

11. The electrical connector as recited in claim 10, wherein the ground plate is made of metal.

12. The electrical connector as recited in claim 1, further comprising a plurality of the housings that each retains a respective plurality of the electrical signal contacts, such that a first plurality of housings retains its respective plurality of electrical signal contacts in a first arrangement, and a second plurality of housings retains its respective plurality of electrical signal contacts in a second arrangement that is different than the first arrangement.

13. The electrical connector as recited in claim 1, wherein the body of the ground plate defines a cross-talk shield.

14. The electrical connector as recited in claim 1, wherein the ground plate includes at least one mounting end that extends from the body and is configured to be mounted onto a printed circuit board.

15. The electrical connector as recited in claim 1, wherein the ground plate defines at least one rib embossed in the body.

16. A ground plate configured to be positioned adjacent a leadframe housing of a leadframe assembly, the ground plate comprising:

a conductive plate body; a plurality of mating ends and mounting ends extending from the plate body, the mating ends configured to mate with electrical contacts of a complementary electrical connector, and the mounting ends configured to be mounted onto a printed circuit board, wherein adjacent ones of the mating ends define respective gaps therebetween, the gaps configured to receive a mating end of at least one electrical signal contact of the leadframe assembly; and a ground coupling beam connected between at least a select pair of the mating ends that extends from the plate body.

17. The ground plate as recited in claim 16, wherein each of the mating ends that extend from the plate body comprises a pair of spaced fingers, such that the ground coupling beam is connected to one of the pair of spaced fingers of the select pair of mating ends, but not both spaced fingers of the select pair of mating ends.

18. The ground plate as recited in claim 16, wherein the conductive plate body defines a cross-talk shield.

19. A plurality of ground plates comprising:

a first ground plate including:

a first body;

a plurality of first mating ends and first mounting ends extending from the first body, the first mating ends configured to mate with electrical contacts of a complementary electrical connector, and the first mounting ends configured to be mounted onto a printed circuit board;

a first ground coupling beam connected between at least a select pair of the first mating ends;

a second ground plate including:

a second body;

a plurality of second mating ends and second mounting ends extending from the second body, the mating ends configured to mate with electrical contacts of the complementary electrical connector, and the mounting ends configured to be mounted onto the printed circuit board; and a second ground coupling beam connected between at least a select pair of the second mating ends, wherein the first mating ends extend from the first body at locations different than locations from which the second mating ends extend from the second body.

20. The plurality of ground plates as recited in claim 19, wherein each of the select pair of the first mating ends define respective first and second pairs of split fingers, such that one but not both fingers of each of the first and second pairs of split fingers is connected to the first ground coupling beam.

* * * * *